United States Patent [19]

Jeambey

[11] Patent Number: 4,817,711

[45] Date of Patent: Apr. 4, 1989

[54] SYSTEM FOR RECOVERY OF PETROLEUM FROM PETROLEUM IMPREGNATED MEDIA

[76] Inventor: Calhoun G. Jeambey, 7485 E. Kenyon Ave., Denver, Colo. 80237

[21] Appl. No.: 55,412

[22] Filed: May 27, 1987

[51] Int. Cl.[4] ..... E21B 43/24; E21B 43/34; E21B 49/00

[52] U.S. Cl. ..... 166/248; 166/60; 166/65.1; 166/66; 166/250; 166/267; 166/302; 73/151; 324/347

[58] Field of Search ..... 166/250, 248, 245, 267, 166/302, 60, 65.1, 66; 73/151; 324/58.5 B, 338, 344, 347

[56] References Cited

U.S. PATENT DOCUMENTS

| | | | |
|---|---|---|---|
| 3,133,592 | 5/1964 | Tomberlin | 166/60 |
| 4,169,506 | 10/1979 | Berry | 166/256 |
| 4,193,448 | 3/1980 | Jeambey | 166/60 |
| 4,301,865 | 11/1981 | Kasevich et al. | 166/248 |
| 4,396,062 | 8/1983 | Iskander | 166/248 |
| 4,449,585 | 5/1984 | Bridges et al. | 166/248 |
| 4,485,868 | 12/1984 | Sresty et al. | 166/248 |
| 4,487,257 | 12/1984 | Dauphine | 166/248 |
| 4,620,593 | 11/1986 | Haagensen | 166/66 X |

OTHER PUBLICATIONS

Magdy R. Iskander, et al., "A Time-Domain Technique for Measurement of the Dielectric Properties of Oil Shale During Processing," Proceeding of the *IEEE,* Mar. 1981, pp. 1-8.

*Primary Examiner*—George A. Suchfield

[57] ABSTRACT

Process for in situ recovery of carbonaceous values from underground petroleum impregnated media such as oil shale, under controlled radiation from a microwave distributing source adjacent the media, e.g. in a borehole, effected in the absence of air, such that the radiation is distributed at least initially at incrementally increasing power and/or at least initially in intermittent interval cycles of on and off duration of the microwaves, for selective pyrolysis of the organic content of the media to liquid, vapor and gas form as the case may be under autogenous pressure in the pores of the media for driving the organic constituents therefrom for appropriate recovery, e.g. via the borehole, including breakup of larger molecules, e.g. hydrocarbons, for selective increase in the noncondensible gas quantities in proportion to the liquid and/or condensible oil vapor quantities, plus pyrolysis scavenging of residual carbon coke by gasification thereof to noncondensible gas constituents, optionally using a portion of the recovered noncondensible gases to produce electrical energy for energizing the microwave source, and conjoint probe apparatus having an adjustable extendable probe end for embedding in the porous media for in situ sensing of changes in the dielectric constant of the carbonaceous constituents undergoing microwave pyrolysis, and a mechanism for indicating the sensed changes, for adjusting the radiation in dependence upon such changes, the degree of extension of the probe end being adjustable in dependence upon the sensed frequency of the attendant radiation.

29 Claims, 3 Drawing Sheets

TYPICAL HEATING CYCLES FOR OIL AND GAS PRODUCTION
FROM OIL SHALE BY MICROWAVE PYROLYSIS (425-500°C)

SYSTEM FOR RECOVERY OF PETROLEUM FROM PETROLEUM IMPREGNATED MEDIA

BACKGROUND OF THE PRESENT INVENTION

The present invention relates to a microwave heating system for recovery of petroleum from petroleum impregnated media, and more particularly to the recovery of extractable organic or carbonaceous values from petroleum impregnated porous media such as oil shale, oil and tar sands, heavy oil reservoir deposits and residual heavy oil pools, e.g. previously subjected to primary oil well drilling extraction, and the like, by the use of microwave or high frequency RF, i.e. radio frequency, radiation energy for in situ heating, preferentially of the liquifiable and gasifiable constituents such as hydrocarbons present in the pores of the media.

Hydrocarbons are found in varying compositions in various underground formation deposits, such as kerogen in oil shale and bitumen in oil sands and tar sands. Likewise, heavy oils with a high viscosity are found in reservoirs located within certain rock or sand formations. These types of hydrocarbons found in such deposits require heat to effect either thermal or chemical change for release and recovery of the desired carbonaceous constituents. Certain known processes require both heating and chemical change to attain such recovery.

However, attempts to recover, in situ, petroleum from oil bearing media have been limited to poorly controllable and inefficient bulk heating or gross heating recovery methods using primarily steam or hot water to heat the media for causing the oil constituents to become sufficiently flowable to be entrained in the steam or hot water and removed in admixture therewith, whereupon the oil has to be separated from the mixture once raised from the underground site to the surface.

These attempts typically require the steam or hot water to pass from the surface down a bore hole to the site of extraction at the underground level of the stratum in question, and to be pumped back to the surface as a mixture with the entrained oil constituents. Since the heating of the underground site is primarily by way of conduction heat transfer, both the desired oil constituents and the entire surrounding rock formation have to be heated in bulk, and the system is beset with pronounced Btu (British thermal unit) heat loss through dissipation during travel of the steam or hot water along the pronounced distances of the bore hole between the surface steam generator or hot water heater and the underground deposit extraction site, in some cases amounting to many thousands of feet of separation.

As a consequence, the overall energy requirement for inefficiently providing such bulk heat at the underground extraction site is so great that these known methods are generally considered commercially impractical and economically unfeasible for industrial scale production purposes.

Even where open pit or strip mining and underground mining via open shaft and gallery arrangements, e.g. using the room and pillar method, are conducted, the attempts have not been successful since on the one hand, the landscape is inherently disturbed by open pit or strip mining and the operation must conform to governmental environmental regulations and on the other hand, the mined oil bearing rock media must be brought in its entirety from the gallery through the shaft to the surface. In both cases, the entire mass of the mixed oil bearing rock media must be subjected to crushing and then retorting in a closed vessel.

Such closed vessel retorting offers poor control and consumes large quantities of energy for heating the rock, as well as the oil, likewise by bulk heating, in most cases with the operation being carried out in the presence of air.

In the usual retorting operation, air is used to burn a portion of the desired oil content by direct combustion therewith in the retorting vessel so as to provide the necessary heat. This expedient not only consumes oil but also results in a gaseous fraction in which the valuable gasified oil constituents are admixed and thus diluted with contaminating gaseous combustion products such as carbon dioxide.

Moreover, where incomplete combustion is carried out, i.e. with the use of smaller amounts of air in proportion to the carbon rich and/or hydrogen rich constituents in the oil, in addition to water formation the retorting leads to the production of carbon monoxide, rather than carbon dioxide, per the well known endothermic reaction by which any formed carbon dioxide is reduced in the presence of excess carbon and/or hydrogen, relative to the attendant oxygen content, to carbon monoxide, depending on the attendant combustion conditions. This renders the heating system nonuniform and causes a loss in heat values to the extent that carbon monoxide, of comparatively low Btu value, is so formed in extra amounts than otherwise.

On the other hand, where the retorting is carried out in the absence of air, i.e. by indirect heat exchange, the bulk heating is even more inefficient, taking longer and thus consuming even more energy.

Present day consensus is that the United States must develop realistic alternative energy sources if the nation, and indeed the industrialized world in general, are to survive the portended future energy crisis.

One possible solution to the energy shortfall facing the United States in particular is the development of the vast oil shale deposits found especially in the States of Colorado, Utah and Wyoming. For instance, oil shale of the Eocene Green River Formation in adjoining corners of these three states is estimated to contain 1.5 trillion barrels (bbls) of potential oil in place. This oil shale has low sulfur and high nitrogen content compared to petroleum as currently obtained.

Present oil shale activity in this regard is essentially experimental and its production insignificant due to the above noted drawbacks. Although many recovery methods are under study from time to time, costs have always been a deterrent, and environmental and/or technical barriers loom as insuperable.

It is estimated that present day oil shale recovery costs amount to from about $35 to $55 per barrel of produced oil, so that it is easy to see why present economics for developing otherwise readily available oil shale deposits are dubious.

As to surface retorting or fired methods, these not only involve the costs for mining the shale but also for crushing the rock to a retortable size, and then carrying out the actual retorting. Underground mining also includes the actual cost of physically bringing the mined rock to the surface through the open shaft.

Certain proposed underground mining methods contemplate the gallery or room and pillar method, but have been initially confined to shales of the mahogany zone that are 1500 feet or less below the surface, and that average 30 gallons per ton (g pt) or more in large beds 30 to 90 feet thick. These limitations are imposed by the costs currently encountered in underground mining.

Underground mining, and even surface mining by way of open pit or strip mining technique, involve measures that require at least five handlings of the shale, e.g. for physically extracting or mining it, hauling it, crushing it, retorting it, and disposing of the solid spent shale rock residue. These collectively constitute a significant collateral cost to shale oil production.

Moreover, the environmentally acceptable disposal of the solid spent shale rock residue from the retorting, which represents about 80–85% of the weight of the shale, is itself costly, and is in addition to the costs of rehabilitating the ground surface to meet governmental environmental regulations in the case of open pit or strip mining, in particular.

In fact, not all underground oil shale deposits lend themselves to mining, and recovery from these deposits is limited to in situ, or in place, methods. A typical example is an oil shale deposit of 625 square miles in the State of Wyoming that is estimated to contain over 200 million barrels of oil per square mile. Unfortunately, where this rich oil shale occurs, the deposits are vertically discontinuous alternating thin horizontal beds of rich and lean oil shale, rather than the more desirable vertically continuous or thick horizontal deposits. Hence, mining oil shale from this deposit is perforce economically unattractive, and recovery would only be practical with in situ or in place methods.

Heat, of course regardless of its source is essential in the processing of oil shale into shale oil whether by mining and then surface retorting or by in situ retorting.

The situation is the same where in situ retorting is used for treating tar sand deposits rather than oil shale. Vast tar sand deposits exist in the United States and Canada which contain very heavy viscous crude oil or bitumen. This bitumen must be heated to facilitate its removal. Present heating methods use surface heated steam to heat the bitumen, e.g. to 300°–400° F. (149°–204° C.), to make it less viscous and thus more readily flowable. Such heating by steam is dependent upon the conduction of heat between fluid molecules, and is subject to heat loss and inefficiency problems.

In fact, the bitumen once recovered from the tar sands deposit must be converted into a light sweet crude before it can be refined or even transported. during such conversion, the bitumen is broken apart thermally into smaller fractions and the resulting material then hydrogenated. This helps to make the material sweeter and lighter. The process is not unlike hydrogenating margarine, and requires carbon removal and the addition of hydrogen, but represents and afterprocessing burden on the overall operation.

North American tar sands deposits are estimated to hold more oil potentially than the entire Middle East, and exploitation of such tar sands deposits could help the industrialized West to achieve energy independence. However, of these vast "heavy oil" deposits, it is considered that only about 100 billion barrels could be recovered within the limitations of current technology and economic conditions. Improved technology would, of course, increase significantly that potential.

A third source of potential fossil energy in significant amounts is found in the still remaining petroleum deposits or heavy crude oil reservoir deposits or residual heavy oil pools previously subjected to primary oil well drilling extraction. These latter deposits which are located in subsurface reservoirs or pools of depleted or partially depleted oil wells, are what remain in exploiting our present main source of petroleum energy from "dome oil" wells. The primary recovery of this oil is effected by sinking wells into oil bearing formations and allowing the natural pressures within the oil impregnated strata to force the fluid into the well bore where it can be conveniently collected by pumping.

In some of these "dome oil" reservoirs and in partially depleted reservoirs there may not be enough natural pressure available to force the oil into the well bore at a sufficient rate to be economically profitable. In other reservoirs the oil flow may be retarded by the "heavy oil" and paraffin content of the petroleum that closes the natural flow channels of these underground crude oil reservoirs. Standard secondary recovery methods such as the injection of water, gas, air or a combination of these materials into the formation are used, as well as the application of heat energy by either chemical or electrical means. Hence, these are often referred to as "huff and puff" pool oil wells.

Where direct firing or in situ retorting of the oil or gas bearing formations in these "dome oil" reservoirs or "huff and puff" pool oil wells is used instead, it is found to produce a contamination of the crude petroleum or gases, and thus suffers from the same drawback as direct firing in the case of surface retorting of mined oil shale.

Chemical heating methods, like hot water and steam heating methods, have generally been unable to provide sufficient heat economically or satisfactory results. For the same reason, electrical resistance heating methods have proven unsuitable in that the transfer of heat to the oil bearing strata is primarily bulk heating or gross heating, accomplished by conduction. In all of these cases, the rate of conduction is low and the heat is continually drawn away from the oil bearing strata by the pumping of the heating oil. Chemically or electrically provided heat must also be expended to heat both the formation itself and the oil.

A particular problem with all conventional downhole heating methods which rely solely on heat conduction is that the heavier crudes, which require most of the heating, are the poorest type of thermal conductors among the crude oils. This aggravates the energy consumption in heating not only the oil but also the surrounding rock, since the rock is a poor thermal conductor as well as must be heated to the same extent as the oil, including the heavier crudes, before the temperature is sufficient consequent such bulk heating or gross heating to facilitate flow of the oil through the channels in the formation to the well bore.

The reason why oil shale requires the application of heat in order to produce oil is because the carbonaceous values contained in the oil shale rock are in the form of solid insoluble organic matter, and not oil. However, this solid organic matter will decompose to yield oil, when heated, i.e. when it is retorted, such oil being recovered in the form of oil vapors along with gas, e.g. non-condensible gaseous constituents admixed with the oil vapor constituents.

In this regard, oil shale has been described as a sedimentary rock with relatively high organic content, e.g. 30–60% volatile matter and fixed carbon, that yields an oil when heated. On the other hand, it does not yield oil when extracted with ordinary solvents. Typical oil shales may yield anywhere from 20–50 gallons of crude oil per ton (gpt), the oil constituents often being of a relatively unsaturated or olefinic character compared to the usual petroleum.

The organic oil yielding matter present in oil shales as solid insoluble matter is generally called kerogen. Kerogen is not considered a definite compound but has been described as a complex mixture of various complex compounds that varies from one shale species to the next, and usually exists as a soft brown powdery material that is at best only slightly soluble in ordinary organic solvents, and that may contain small proportions of nitrogen and sulfur constituents as well as oxygen, e.g. as hetero atoms. The porous rock matrix in which the kerogen is situated in oil shale usually contains associated free water and bound water of crystallization, e.g. where the rock consists of carbonates, silicates, aluminates, etc., often in conjunction with pyrites.

Kerogen in oil shale must be heated to high temperature before it pyrolyzes or decomposes. For this reason, in the case of surface retorting, the mined oil shale must first be crushed to reduce its size for more efficient exposure of the material to the heat. Despite significant world oil price increases, a primary reason why the known mining, crushing and retorting technique for recovering oil from oil shale has still not become commercially viable is because oil shale is a relatively lean ore.

Experience has shown that even a ton of relative rich oil shale of 25 gpt (but actually a lean ore at 0.0125 gallon per pound, i.e. 25/2000) will only produce about 0.6 barrel of oil, after expending elaborate efforts in the five handlings of mining, hauling, crushing and retorting the shale, and then disposing of the spent shale within environmentally acceptable guidelines, aside from the energy consumed in bulk heating of the shale to accomplish pyrolysis of the kerogen during the retorting.

The alternative of bulk heating of the oil shale in a surface retort is by burning or retorting it in place underground by direct combustion of a portion of the kerogen content with supplied extraneous air, but such is no less impracticable, aside from the contamination of the produced oil with combustion products and possible environmental hazards. This is because much of the oil shale encountered underground is nearly impermeable, despite its internal content of tiny pores containing the kerogen, and must first be mechanically broken up in order to permit the hot combustion gas to pass through it.

A satisfactory method to break up shale oil deposits in place has not been found. The present method involves blasting the rock and the removal of a portion of the rubble (about 25%) to allow for a fire-flow through the fractured deposit. Results are less than satisfactory because of the inefficient burning of the shale due to the non uniform size of the rubble.

Actually, oil shale deposits exist as planes or discontinuous deposits or beds of varied thickness at random levels along the underground formation, and each may be a relatively rich or a relatively poor oil shale plane or bed alternating with intervening planes or beds of barren rock.

Because of the nature of the particular porous media and its impregnated petroleum content, whether in the form of oil shale, oil sands, tar sands, heavy oil reservoir deposits, residual heavy oil pools, e.g. previously subjected to primary oil well drilling extraction, and the like, the manner in which the particular deposit of the porous media occurs in the underground formation, e.g. in lean and rich discrete beds, often of narrow seam height randomly disposed along the vertical course of the formation, and/or in deposits or reservoirs or pools of pronounced depth from the ground surface, and furthermore, because of the inefficiencies and cost of gross heating or bulk heating, whether by in situ heating using hot water or steam, or chemical or electrical heating means, or by in situ retorting or direct firing with supplied extraneous air, or by surface retorting using direct firing with supplied extraneous air or indirect heat exchange, normally preceded by crushing and followed by spent shale disposal, none of these known techniques has been commercially successful or competitive with petroleum obtained by the usual primary oil drilling methods from dome oil reservoirs and the like.

U.S. Pat. No. 4,193,448, issued Mar. 18, 1980 to Calhoun G. Jeambey, discloses and claims an apparatus, e.g. in the form of an elongated shell attached to the lower end of a pipe arrangement, for recovery of petroleum from petroleum impregnated media such as rock, shale and sands, and includes an electrically energized microwave generator and a guide for directing microwaves to a microwave dispersing chamber for heating the media, plus a plurality of holes in the shell for the inflow of heated petroleum into a petroleum chamber from the heated media. The apparatus is inserted into an opening, e.g. a borehole, in the media, then microwaves are dispersed into the media to heat the same, and the heated petroleum is recovered therefrom in the petroleum chamber via the holes. The system is safe, cost efficient and at least as fast as conventional methods for the recovery of oil from shale, while using substantially less energy than that required for conventional heating methods. In particular, there is no substantial alternation of the landscape nor appreciable environmental impact since the heating and recovery operations are conducted underground, i.e. at a downhole site in the borehole.

However, U.S. Pat. No. 4,193,448 does not disclose extensive or particularized details as to the actual process of extracting or recovering in situ the petroleum or oil from the impregnated media, let alone the pyrolysis production of both oil and gas, including that traceable to residual solid form carbon coke remaining after pyrolysis of kerogen, etc. to remove the initially generated liquid and gas constituents, while permitting molecular break down or "cracking" of the attendant hydrocarbon constituents to smaller molecules and particularly to increasing proportional amounts of noncondensible gases.

SUMMARY OF THE INVENTION

It is among the objects and advantages of the present invention to overcome the deficiencies and drawbacks of the prior art, and to provide an economical and efficient process for in situ or in place recovery of extractable carbonaceous values, such as hydrocarbons from underground petroleum impregnated porous media, such as oil shale, oil and tar sands, heavy oil reservoirs and residual heavy oil pools previously subjected to primary oil well drilling extraction and the like type sources of synthetic fuel in which microwave radiation or radio frequency (RF) energy is applied to the media, such as from a microwave distributing or generating source substantially immediately adjacent the media, and distributed at least initially at incrementally increasing radiation power and/or in intermittent cycles of on and off durationo, e.g., for preferentially heating the petroleum content in the media selectively to a temperature sufficient for correspondingly liquifying and gasifying the liquifiable and volatilizable and constituents present, and incrementally progressively in a direction away from the source, to cause the thereby liquified and gasified constituents to migrate under autogenous pressure through the porous media in a direction toward the source, for recovery from the vicinity of the source.

It is among the additional objects and advantages of the present invention to provide a process of the foregoing type, in which the microwave heating temperature is selected to cause the liquified constituents predominantly to gasify for forming a mixture of predominantly gasified constituents and a minor amount of residual liquified constituents, and/or in which after recovery substantially of the liquified and gasified constituents from the media the microwave heating temperature is raised selectively for causing residual unliquified and ungasified carbon constituents present in the media to gasify and migrate under autogenous pressure for like recovery from the vicinity of the source, and/or especially in which a portion of the recovered, e.g. gasified, constituents is used to produce electrical energy for energizing the microwave distributing or generating source.

It is among the further objects and advantages of the present invention to provide a process of the stated type, in which the distribution and utilization of the microwave generated energy, such as from the in situ microwave distributor source locally adjacent the in situ media is selectively controlled in dispersement pattern, in intermittent interval cycle or continuous duration, as well as in varying or constant power as the case may be, as it relates to the heating of the organic material present in the media, for maximizing the oil and gas recovery capacity of the system by confining the energy distribution to a selective specific zone and by avoiding overheating of the media adjacent the microwave distributor source while preferentially heating the petroleum constituents progressively along the extent of the zone, from the portions thereof adjacent to those remote from such source.

It is among the still further objects and advantages of the present invention to provide a process of the stated type; which is able to use radio frequency or microwave energy for in situ heating of the media for commercially producing oil and gas on an industrial scale that is both technically and economically feasible, enabling large deposits of readily accessible oil shale to be exploited, which for example, even at a modest 25% recovery factor would yield in excess of an estimated 210 million barrels of oil from a given set of oil shale containing sections in the State of Wyoming alone, and in any case at an estimated cost below or competitive with current world market oil prices; which potentially produces all of its own field energy requirements from the recovered product itself, such product constituting a relatively clean oil product in comparison to that obtained by conventional retorting methods; and which requires almost no water and has virtually no negative environmental impact.

It is among the still further objects and advantages of the present invention to provide a sensing and indicating apparatus including a sensing probe for embedding in the underground porous media being worked for carrying out the pyrolysis under an ongoing indication of the changes in the dielectric constant of the constituents being pyrolyzed as a function of the microwave radiation being applied and optionally with associated means for sensing prevailing temperatures for controlling the operating conditions for optimum RF energy utilization.

It is among the still further objects and advantages of the present invention to provide an array of such probes in a given underground porous media site being worked and for undertaking microwave pyrolysis in conjunction therewith for ongoing measurement and control of the operating conditions, and to obtain operating condition information applicable for carrying out the pyrolysis at further underground porous media sites having comparable carbonaceous values and mineral content to that of the first mentioned site but without the need to use such array of probes at those further sites.

It is among the still further objects and advantages of the present invention to provide a process of the stated type for carrying out the extraction of extractable carbonaceous values substantially simultaneously at a plurality of separate individual sites using at each site microwave radiation distributed at least initially in successive intermittent interval alternate cycles of on and off duration for heating the impregnated petroleum content, such that some of the microwave sources at some of the sites are only energized during the alternate off duration cycles of the remainder of the microwave sources at the remainder of the sites respectively, and in turn the remainder of the microwave sources are only energized during the alternate of duration cycles of the first mentioned microwave sources, for substantially complete electric energy utilization.

BRIEF DESCRIPTION OF THE DRAWINGS

Other and further objects and advantages of the present invention will become apparent from a study of the within specification and accompanying drawings, in which.

DETAILED DESCRIPTION OF THE INVENTION

Figure 1:
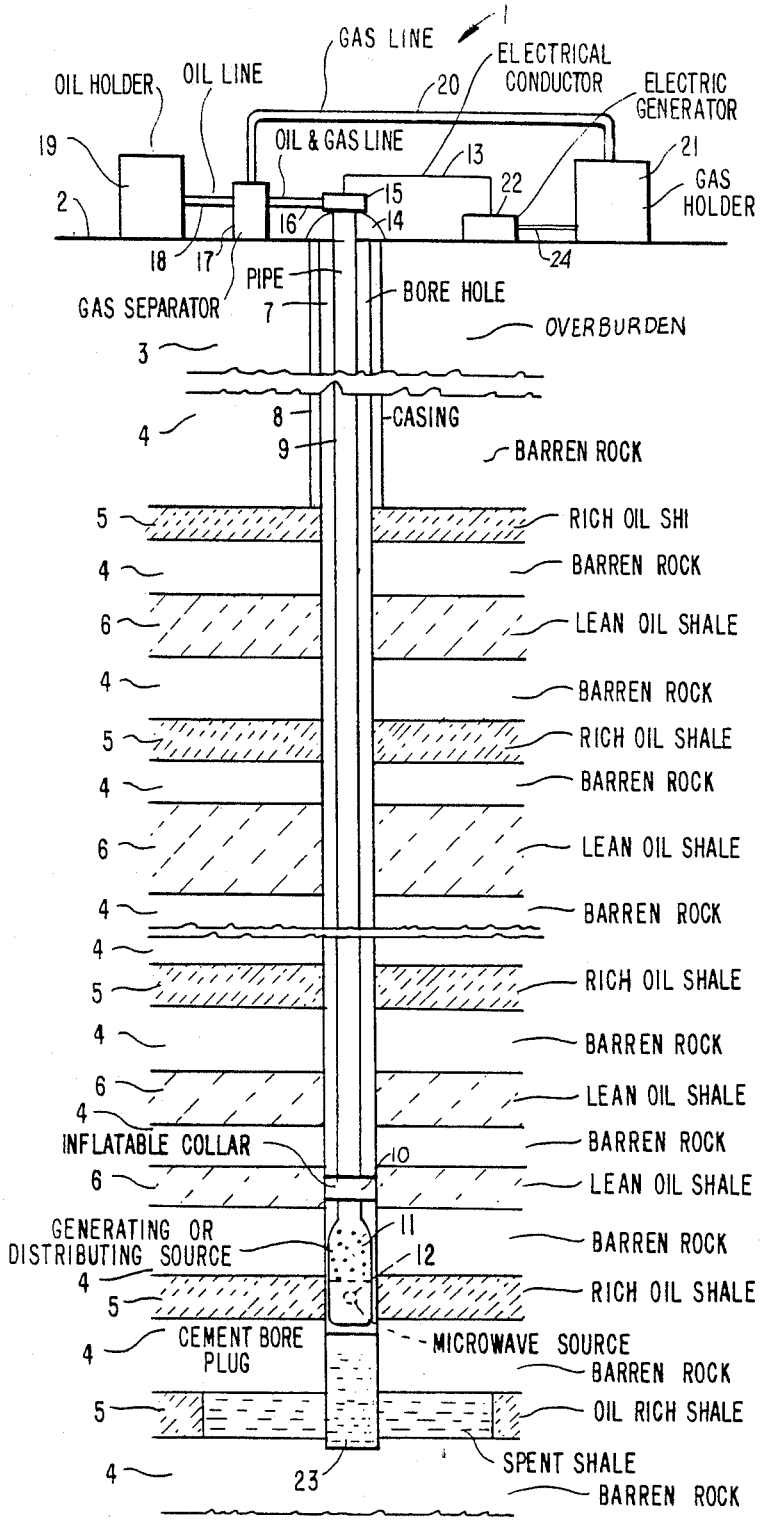
FIG. 1 is a schematic sectional view of a formation installation at a borehole or well bore with respect to which the process for in situ recovery of extractable carbonaceous values may be carried out according to the present invention.

According to a first main aspect of the present invention, a process for in situ recovery of extractable carbonaceous values from underground petroleum impregnated porous media is provided, comprising subjecting the underground petroleum impregnated porous media, in situ and in the substantial absence of air, to microwave radiation from a microwave distributing source substantially immediately adjacent the media and distributed at least initially at incrementally increasing radiation powder, for heating the impregnated petroleum content preferentially relative to the corresponding porous media and progressively in a direction away from the microwave source.

Such heating is effected to a selective temperature of at least about 425° C. and sufficiently for liquifying substantially the liquifiable petroleum constituents present which liquify at the corresponding heating temperature and for gasifying substantially the volatilizable petroleum constituents present which gasify at such heating temperature and in turn for causing the thereby formed mixture of liquified and gasified constituents to migrate under autogenous pressure through the porous media in a direction toward the microwave source. Hence, the migrating constituents can be readily recovered from the vicinity of the microwave source.

Thus, in accordance with a cycle feature of the present invention, the radiation may be distributed at least initially in intermittent interval cycles of on and off duration, for instance such that at least initially the intervals of on duration progressively increase, and/or such that at least initially the intervals of off duration progressively decrease.

In particular, the radiation may be distributed initially in intermittent interval cycles of on and off duration in a first phase, and thereafter be distributed substantially continuously in a second phase, for instance with the intervals of on duration progressively increasing in the first phase and/or the intervals of off duration progressively decreasing in the first phase.

Also, in accordance with a power level feature of the present invention, the radiation may be distributed initially at incrementally increasing radiation power in the first phase, and thereafter be distributed at substantially constant correspondingly increased power in the second phase. in conjunction therewith, the radiation may be distributed in such intermittent interval cycles of on and off duration in the first phase, for instance with the intervals of on duration progressively increasing and/or the intervals of off duration progressively decreasing, and thereafter the radiation may be distributed substantially continuously in the second phase.

Moreover, in accordance with a distance range feature of the present invention, the radiation may be distributed for heating the impregnated petroleum content to the linear extent of at least about 30 feet in at least one direction away from the microwave source.

In particular, the radiation may be distributed initially at incrementally increasing radiation power and until the heating of the impregnated petroleum content has progressed to the linear extent of at least about 20 feet in at least one direction away from the microwave source in the first phase, and thereafter may be distributed at substantially constant correspondingly increased power in such direction in the second phase.

In conjunction therewith, as before, the radiation may be distributed initially in intermittent interval cycles of on and off duration in the first phase, and thereafter be distributed substantially continuously in the second phase, especially with the intervals of on duration progressively increasing and/or the intervals of off duration progressively decreasing in the first phase.

Furthermore, in accordance with a temperature control feature of the present invention, the heating temperature may be maintained at between about 425°-500° C., for instance between about 425°-475° C. for thereby forming a mixture of predominantly liquified constituents and a corresponding remaining minor amount of gasified constituents, or between about 476°-500°C. for thereby forming a mixture of predominantly gasified constituents and a corresponding remaining minor amount of liquified constituents.

In particular, in a first step the radiation may be distributed until substantially all of the liquifiable and volatilizable constituents present which concordantly liquify and gasify at the corresponding heating temperature have been liquified and gasified and in turn recovered, and thereby leave a remainder content of residual unliquified and ungasified carbon constituents in the corresponding porous media, and in a second step substantially without interruption the porous media may be thereafter subjected to continued radiation from the microwave source correspondingly for heating such residual carbon constituents to a selective temperature of at least substantially about 525° C. and below about 600° C. and sufficiently for gasifying substantially such residual carbon constituents and in turn for causing the thereby gasified residual carbon constituents to migrate under autogenous pressure through the porous media in a direction toward the microwave source. The migrating gasified residual carbon constituents may then likewise be recovered from the vicinity of the microwave source.

The microwave source may be favorably located in a well bore at a level adjacent the underground stratum of the porous media, and the migrating constituents thus may be recovered from the vicinity of the microwave source via the well bore.

In particular, where the porous media are oil shale media, the carbonaceous values will include kerogen which is correspondingly pyrolyzed by the microwave heating.

Advantageously, a portion of the recovered constituents is used to produce electrical energy for energizing the microwave distributing source.

According to a second main aspect of the present invention, a process for in situ recovery of extractable carbonaceous values from underground petroleum impregnated porous media is provided, comprising two steps.

The first step comprises subjecting an underground stratum of the petroleum impregnated porous media, in situ and in the substantial absence of air, to microwave radiation from a microwave distributing source located in a well bore at a level substantially immediately adjacent such underground stratum, for heating the impregnated petroleum content to a selective temperature sufficiently for liquifying substantially the liquifiable petroleum constituents present which liquify at the corresponding heating temperature and for gasifying substantially the volatilizable petroleum constituents present which gasify at such heating temperature and in turn for causing the thereby formed mixture of liquified and gasified constituents to migrate under autogenous pressure through the porous media in a direction toward the microwave source, and recovering the migrating constituents from the vicinity of the microwave source via the well bore.

The selective temperature of the first step is insufficient for liquifying and gasifying residual carbon constituents in the corresponding porous media, and thereby leaves a remainder content of residual unliquified and ungasified carbon constituents therein.

The second step comprises, substantially without interruption relative to the first step, subjecting the porous media thereafter to continued radiation from the microwave source correspondingly for heating such remainder content of residual unliquified and ungasified carbon constituents therein to a selective increased temperature sufficiently for gasifying substantially such residual carbon constituents and in turn for causing the thereby gasified residual carbon constituents to migrate under autogenous pressure through the porous media in a direction toward the microwave source, and recovering the migrating gasified residual carbon constituents from the vicinity of the microwave source via the well bore.

In particular, the first step temperature may be between about 425°-500° C. and the second step temperature may be at least substantially about 525° C. and below about 600° C.

Preferably, a portionm of the recovered gasified constituents includes noncondensible gas and at least a portion of such noncondensible gas is used to produce electrical energy for energizing the microwave distributing source. Hence, advantageously the first step temperature may be between about 476°-500°C. for thereby forming a mixture of predominantly gasified constituents and a corresponding remaining minor amount of liquified constituents.

Accordingly, where the porous media are oil shale media, the carbonaceous values will include kerogen which is correspondingly pyrolyzed by the microwave heating to provide such liquified and condensible and noncondensible gasified products.

According to a third main aspect of the present invention, a probe system or apparatus is provided for in situ sensing of changes in the dielectric constant of extractable carbonaceous values, e.g. hydrocarbons, in underground petroleum impregnated porous media during the subjecting thereof in situ to microwave radiation.

The probe apparatus comprises an open ended coaxial transmission line having an in situ probe end and a remote end, and includes a conductive probe as core conductor insulated or separated electrically from its counterpart coaxial conductive jacket as peripheral conductor by an insulating material, e.g. high temperature resistant thermosetting plastic, or alternatively, a void annular space or vacuum space from which air has been excluded and which may optionally be filled by captively contained inert gas and provided with insulating fixed radial spacers keeping the probe and jacket electrically apart along the course of the transmission line and with gas sealing insulating end radial spacers plugging the opposed ends of the transmission line or at least the in situ probe end.

The probe is arranged for axial movement relative to the jacket and relative to such plastic, or to such radial spacers where alternatively present, for extending the adjacent end portion of the probe a selective distance beyond the in situ probe end of the line or provide an adjustable length exposed probe end portion for embedding in such porous media.

Furthermore, indicating means are arranged at the remote end of the line for indicating the sensed changes in such dielectric constant.

Faborably, an associated conventional in situ thermal analysis device or means, or like type temperature sensing and recording means, is also provided in the probe apparatus, having a sensing portion adjacent the in situ probe end for embedding in the porous media whereby to sense and record the prevailing temperature at the particular in situ probe site.

In turn, such indicating means arranged at the remote end of the line are also arranged in this instance for indicating the temperature sensed by the sensing portionm at the in situ probe site.

In conjunction therewith, according to a fourth main aspect of the present invention, a method of using the above noted probe system or apparatus is in turn provided.

The method comprises embedding the probe end of the coaxial transmission line in an underground petroleum impregnated porous media and placing the remote end of the transmission line and the indicating means at a remote location relative to the porous media, subjecting the porous media in situ to microwave radiation sufficiently for heating the impregnated petroleum content for extracting the extractable carbonaceous values therefrom, sensing changes in the dielectric constant of the extractable carbonaceous values, during the microwave radiation heating of such petroleum content, by the embedded probe end of the transmission line, and indicating the sensed changes by the indicating means at the remote end of the transmission line, and adjusting the microwave radiation in dependence upon the sensed changes in such dielectric constant.

More particularly, the method of using the probe apparatus may be carried out such that the exposed length of the end portion of the embedded probe end is adjusted in dependence upon the frequency of the attendant microwave radiation.

Desirably, such method further includes sensing in situ, e.g. via such sensing portion of the associated thermal analysis means, the prevailing temperature at the in situ probe site, and adjusting the microwave radiation in dependence upon the sensed changes in dielectric constant in conjunction with sensed changes in temperature, e.g. as recorded by such indicating means.

According to a related fifth main aspect of the present invention, an analogous process for in situ recovery of extractable carbonaceous values from underground petroleum impregnated porous media is provided utilizing an array of dielectric constant sensing probes.

Desirably, such method further includes sensing in situ, e.g. via such sensing portion of the associated thermal analysis means, the prevailing temperature at the in situ probe site, and adjusting the microwave radiation in dependence upon the sensed changes in dielectric constant in conjunction with sensed changes in temperature, e.g. as recorded by such indicating means.

According to a related fifth main aspect of the present invention, an analogous process for in situ recovery of extractable carbonaceous values from underground petroleum impregnated porous media is provided utilizing an array of dielectric constant sensing probes.

This analogous process comprises positioning a microwave distributing sources in a bore hole t a vertical level adjacent the underground petroleum impregnated porous media, and also positioning such as array of dielectric constant sensing probes in a corresponding array of probe accommodating bores selectively positioned in spaced relation to each other and at conjointly incrementally increasing progressive radial distances from the bore hole as center such that the probes are at substantially the same vertical level as the microwave distributing source and are respectively embedded in situ in the adjacent underground petroleum impregnated porous media thereat.

In turn, the porous media is subjected in situ to microwave radiation from the microwave source sufficiently for heating the impregnated petroleum content for extracting the extractable carbonaceous values therefrom while sensing changes in the dielectric constant of the extractable carbonaceous values, during the microwave radiation heating of the petroleum content, by the corresponding probes along the progressive radial distances thereof from the bore hole, and the microwave radiation is correspondingly adjusted n dependence upon the sensed changes in such dielectric constant.

Preferably, the array of probe bores and probes is substantially in the form of an outwardly increasing radius spiral arrangement at least partially around the bore hole as center.

Advantageously, the sensed changes in dielectric content are recorded, and the process is repeated at a separate bore hole site having underground petroleum impregnated porous media of substantially the same content of carbonaceous values and mineral as the first mentioned porous media, but in this instance, without the array of probe bores and probes being used, instead carrying out the microwave radiation in dependence upon such already recorded sensed changes in dielectric constant.

Advantageously, the sensed changes in dielectric content are recorded, and the process is repeated at a separate bore hole site having underground petroleum impregnated porous media of substantially the same content of carbonaceous values and mineral as the first mentioned porous media, but in this instance without the array of probe bores and probes being used, instead carrying out the microwave radiation in dependence upon such already recorded sensed changes in dielectric constant.

Here also, the probes desirably include such associated thermal analysis means for sensing the prevailing temperature, and the thermal analysis means are also respectively embedded in situ in the adjacent porous media thereat, such that the microwave radiation is adjusted in dependence upon the sensed changes in dielectric constant in conjunction with sensed changes in such temperature.

In like manner, upon correspondingly recording the sensed changes in dielectric constant and prevailing temperature, the process may be repeated at such a separate bore site, again without the array of probe bores and probes and associated thermal analysis means, instead carrying out the microwave radiation in dependence upon such already recorded sensed changes in dielectric constant and prevailing temperature.

According to a sixth main aspect of the present invention, a multiple site process for in situ recovery of extractable carbonaceous values from underground petroleum impregnated porous media is provided, comprising substantially simultaneously subjecting each of a plurality of separate individual sites of underground petroleum impregnated porous media, in situ and in the substantial absence of air, to microwave radiation from each of a corresponding plurality of microwave distributing sources substantially immediately adjacent the porous media at each such site respectively.

The microwave radiation is distributed at least initially in successive intermittent interval alternate cycles of on and of duration and sufficiently for heating the impregnated petroleum content for extracting extractable carbonaceous values therefrom, while correspondingly at least initially selectively alternatively supplying electrical energy concordantly in successive intermittent interval alternate cycles of no and off duration to the corresponding microwave sources.

In this way, electively some of the plurality of microwave sources are only energized during the alternate off duration cycles of the remainder of the plurality of microwave sources, and in turn the remainder of the microwave sources are only energized during the alternate off duration cycles of the first mentioned microwave sources, for substantially complete utilization of the supplied electrical energy, and accordingly the thereby extracted carbonaceous values are in turn recovered.

Preferably, at least a portion of the recovered carbonaceous values is used to produce the electrical energy supplied to the plurality of microwave sources.

Desirably, the microwave radiation is distributed at least initially also at incrementally increasing radiation power and in intermittent cycles of on and off duration in a first phase, and thereafter is distributed at substantially constant correspondingly increased power to each of the microwave sources in a second phase under a concordantly increased supply of electric energy sufficiently to energize substantially simultaneously and continuously all of the microwave sources at such constant increased power at the same time.

In the latter instance, where at least a portion of the recovered carbonaceous values is used to produce the electric energy supplied to the plurality of microwave sources, correspondingly also at least a further portion of the recovered carbonaceous values is used to produce the increased supply of electrical energy used in the second phase.

Broadly, in regard to a power distribution overall feature of the present invention, a process for in situ recovery of extractable carbonaceous values from underground petroleum impregnated porous media is provided, comprising subjecting such media in situ to microwave radiation from a microwave distributing source and distributed at least initially at incrementally increasing radiation power and sufficiently for heating the impregnated petroleum content for extracting extractable carbonaceous values therefrom, and recovering the thereby extracted carbonaceous values.

Preferably, the radiation is distributed initially at incrementally increasing radiation power in a first phase, and thereafter is distributed at substantially constant correspondingly increased power in a second phase.

Optionally, the radiation is distributed at least initially also in intermittent cycles of on and off duration, and preferably is distributed initially in intermittent interval cycles of on and off duration in a first phase, and thereafter is distributed substantially continuously in a second phase.

Favorably, in this regard, the radiation is distributed initially both at incrementally increasing radiation power and in intermittent cycles of on and off duration in a first phase, and thereafter is distributed at substantially constant correspondingly increased power continuously in a second phase.

Broadly, in regard to a duration distribution overall feature of the present invention, a process for in situ recovery of extractable carbonaceous values from underground petroleum impregnated porous media is provided, comprising subjecting such media in situ to microwave radiation from a microwave distributing source and distributed at least initially in intermittent cycles of on and off duration and sufficiently for heating the impregnated petroleum content for extracting extractable carbonaceous values therefrom, and recovering the thereby extracted carbonaceous values.

Preferably, the radiation is distributed initially in intermittent interval cycles of on and off duration in a first phase, and thereafter is distributed substantially continuously in a second phase.

Microwaves constitute comparatively high frequency electromagnetic waves of short wave length. Microwave heating concerns the subjecting of materials to such high frequency electromagnetic waves whereby the microwave absorbent molecules in the materials are excited thereby and their agitation creates heat. On the other hand, certain materials are microwave transparent, having the ability to transmit microwaves without resistance or absorption and this without being heated thereby.

Microwave generating systems, such as that contemplated in the apparatus of said U.S. Pat. No. 4,193,448, which are capable of providing microwave planar radiation, i.e. generating a horizontal microwave radiated pattern confined to a selective predetermined vertical area, are particularly suitable for carrying out the in situ extraction or recovery of carbonaceous values from porous petroleum impregnated media such as oil shale, oil and tar sands and residual heavy oil pools, according to the process of the present invention, especially in the case of vertically discontinuous oil shale beds.

By distributing such microwave radiation or energy from a bore hole into the media being worked, the high frequency radio waves provide heat energy which causes in situ heating of the oil bearing media or ore, and such may be carried out under controlled conditions to cause the hydrocarbon molecules in any solid organic matter or kerogen in the deposit to become liquid and then vaporize, as in the case of oil shale, or to cause such molecules in any liquid organic matter or petroleum oil or bitumen in the deposit to vaporize directly, as in the case of oil and tar sands and/or residual heavy oil pools, all within a selective predetermined vertical area and a corresponding horizontal arc of selective angular extent from the bore hole as center or over the full 360 degree circumference of the radial area being worked.

In the case of oil shale, hydrogen and methane are the two major gases given off when the shale is heated. These noncondensible gases assist the flow of the oil constituents within the shale in the direction of the borehole. The created gases are advantageously captured and may be used to power a surface electrical generator, e.g. a fuel cell such as a 1-KW Raytheon fuel cell electrical generator or the like.

In fact, considering that the drilling and microwave extraction operations normally occur in remote and sparsely populated locations, a ready source of extra electrical energy is inherently available for consumption by local communities, otherwise dependent on power supplied over long distance transmission line networks, by converting any surplus of the captured gaseous constituents provided by the oil shale via such a surface generator fuel cell or the like for that local consumption.

Advantageously, the removal of the organic material or kerogen from the oil shale deposits, according to the process of the present invention, does not appear to affect adversely the remaining crystalline rock or matrix insofar as its physical arrangement is concerned. Hence, regardless of the depth of the bed being worked, it is believed that the depleted or spent shale remaining after the microwave extraction operation will continue to support the overburden without significant concern for sinking or cave-in of the land thereat. Consequently, even in this respect, the operation does not appear to disturb the ecology of the region in any substantial way.

Referring to the drawings, and initially to FIG. 1, an arrangement 1 is shown on the ground surface 2 of an underground formation 3 of oil shale containing subterranean strata, including a series of levels of barren rock 4 containing intervening levels in generally horizontally extending planes of rich oil shale beds 5 and lean oil shale beds 6 of varying vertical thickness and random ordinal sequence downwardly along the depth of the formation 3, e.g. starting at an upper level depth of 500 or 600 feet below ground and going down to a lower level depth of 1100 or 1200 feet below ground. It will be understood that in certain deposits there may be little, if any barren rock strata whereupon the separate strata will comprise only rich oil shale deposits or lean oil shale deposits.

The rich oil shale beds 5 may, for instance, comprise about 20 or so vertically discontinuous horizontal beds averaging about 3 feet in vertical thickness separated by low grade or lean oil shale beds 6, the various beds lying in substantially horizontal planes whose deviation from true horizontal is minimal, e.g. less than 1%.

The formation 3 has a bore hole or well bore 7 which has been drilled in conventional manner to the level of the lowermost oil shale bed from which the carbonaceous material is to be extracted according to the present invention.

Because of the manner of recovering the carbonaceous material from the beds, the bore hole 7 is normally not provided with a casing 8, or at least such casing 8 where present does not extend downwardly far enough to seal off the particular oil shale bed being worked from access to the bore hole 7.

Alternatively, the casing 8 may be provided with a plurality of inflow apertures therethrough (not shown)

around its circumference and at least along the lowermost vertical end or extent thereof corresponding in vertical length substantially to the vertical thickness or height of the oil shale beds to be worked to assure recovery of the exuding carbonaceous material from the bed via the apertures and into the interior of the casing 8.

Where such a casing 8 is used without apertures, then the casing must be mounted via conventional means (not shown) at the surface 2 to permit it to be raised incrementally from the bore hole 7 so that its lower end or extent is above the particular bed being worked. Similarly, where the casing 8 is provided with apertures only at its lowermost end or extent, then it must be mounted by such means (not shown) to permit it to be raised each time so that its lower end or extent is adjacent with the particular bed being worked for registering its inflow apertures with the adjacent surface portions of the bore hole 3 constituting the bed.

In any case, within the bore hole 7 and/or the casing 8, a delivery or outlet pipe 9 is lowered until its lower end, which is desirably provided with a conventional inflatable sealing collar 10, is just above the bed to be worked. Attached to the lower end of the pipe 9 is a microwave generator unit 11 such as that disclosed and claimed in said U.S. Pat. No. 4,193,448 to Calhoun G. Jeambey.

This unit 11 contains a lower microwave generating or distributing source 12 (shown in phantom), and an upper recovery chamber (not shown) which is in flow communication with the bore hole 7 via a plurality of holes throughout its exterior wall circumference and which leads interiorly to an outer concentric flow path at its upper end passing upwardly through the outlet pipe 9 to the surface 2. The recovery chamber is separated from the microwave source 12 by a suitable internal wall and is arranged to receive oil and gas constituents via the holes for recovery via the outer concentric flow path in pipe 9.

An electrical conductor 13 extends from the surface 2 down through the pipe 9 and unit 11 to the microwave source 12 to energize the source in the desired manner. This conductor 13 is separated from the outer concentric flow path within the pipe 9 by an internal pipe or the like (now shown) containing the conductor 13 and which also extends from the surface 2 to the unit 11, terminating at the microwave source 12.

The pipe 9 is anchored at the surface 2 via a releasable holding mechanism 14 in conventional manner to permit vertical movement thereof (and/or of the casing 8 where also present) for aligning its lower end such that the unit 11 is locatable adjacent the particular bed to be worked and in flow communication relation therewith whereupon the holding mechanism 14 is locked to maintain the pipe 9 in static suspended state within the bore hole 7.

Then the collar 10 is inflated to seal off the area of the bore hole 7 above the collar 10 from the area therebelow. On the other hand, the lower end of the bore hole 7 is per se sealed by the underlying barren rock formation thereat.

In this condition of the installation, the microwave unit 11 may be operated for heating the oil shale bed and recovering the exuding or emitted carbonaceous material in the form of oil and gas constituents.

Since the borehole section containing the microwave unit 11 is sealed from above by the collar 10 and by the closed off end therebelow, not only will the area be sealed off from extraneous air, but the generated and emitted carbonaceous constituents will be readily recovered via the recovery chamber of the microwave unit 11.

The top end of the pipe 9 is enclosed by a sealing recovery cap system 15 which communicates the outer concentric flow path of the pipe 9 with an oil and gas recovery line 16 leading to a gas separator 17, from which the oil constituents flow via oil line 18 to the oil holder 19, while the separated gas constituents flow via gas line 20 to a gas holder 21.

The electrical conductor 13 passes separately from the cap system 15 to an electrical generator 22 used to generate the electricity for energizing the microwave generating or distributing source 12 in the unit 11.

The cap system 15, holding mechanism 14 and pipe 9 plus recovery line 16 and electrical conductor 13 are arranged in well known manner for positioning the lower end of the pipe 9 at any given point within the bore hole 7 and for raising the pipe 9 successively from the lowermost point to each next upper point at which a bed to be worked is located, while permitting delivery of power via electrical conductor 13 and product recovery via line 16 during the microwave oil and gas production working operation, as the artisan will appreciate.

After a given oil shale bed has been worked, the portion of the bore hole 7 extending upwardly to the next successive oil shale bed to be worked is sealed by a cement bore plug 23, thus preventing downflow of any of the carbonaceous constituents from such next above bed and reverse entry into the spent residual shale at the next below bed.

This operation is repeated successively upwardly along the formation 3 for effectively limiting movement of the exuding or emitted oil and gas constituents from a given bed between the adjacent underlying cement bore plug 23 and the overlying collar 10, in the range of the bore hole 7 corresponding to the height of the oil shale bed and to the holes in the recovery chamber wall of the unit 11.

The unit 11, per said U.S. Pat. No. 4,193,448, is able to produce controllable microwave planar radiation patterns, i.e. vertically interposed between levels of barren rock, in an arrangement such as shown in FIG. 1.

Thus, once the bore hole 7 is drilled and the pipe 9 with the unit 11 attached at its lower end is inserted therein and positioned to align the unit 11 with the level of the oil shale bed being worked, the microwave source 12 may be energized to cause microwave radio frequency or RF energy to radiate into the oil shale surrounding the bore hole 7. After all the oil shale beds have been successively worked, the entire arrangement 1 may be moved to the next hole and the operation repeated.

According to the process of the present invention, the frequency of the radiated microwave energy is selectively matched to the characteristics of the rock of the oil shale bed for preferential or selective heating of the carbonaceous material, i.e. organic matter generally in the form of kerogen and providing liquifiable constituents and volatilizable or gasifiable or vaporizable constituents. It has been determined that oil shale minerals in the rock or porous impregnated media constituting the oil shale bed absorb relatively little of the RF energy, so that the organic matter in the pores of the media is preferentially heated.

Since the organic matter occupies more than about one third of the total volume of the rock. e.g., in the case of 30 gpt oil shale, the organic matter or kerogen will preferentially absorb the microwave or RF energy until the contemplated emitting temperature or pyrolysis temperature is reached, whereupon the organic matter decomposes or pyrolyzes, yielding constituents such as flowable or liquid oil, oil vapors, noncondensible gases, some water and a residual solid carbon or coke content in situ in the pores of the mineral or rock media.

As will be appreciated hereinafter, a higher order of magnitude emitting temperature must be subsequently maintained in a second step or stage in order to achieve gasification of such residual solid carbon or coke.

Nevertheless, at this intermediate point or first step or stage, the residual solid carbon or coke generally occupies only about 10 vol. % of the pore space previously occupied by the organic matter. The void space thus created provides a continuously developing pathway in a direction away from the microwave source and further into the oil shale media for escaping vapors.

Under the intense preferential absorption of the RF energy by the organic matter, the liquid oil constituents vaporize and flow along with the other gaseous constituents, including vaporized water, as escaping vapors through the maze of these created void spaces. These vapors are forced in a direction towards the bore hole 7 because of the huge volume increase accompanying volatilization of the preferentially heated constituents and the consequent attendant autogenous pressure.

It will be realized that the generated vapors have little ability in that form for absorbing RF energy, and instead progressive production will heat the residual rock, mainly by inherent conduction heat transfer along the created flow paths to the bore hole 7 and this will ensure movement of the vapors to bore hole 7 for recovery via the recovery chamber in the unit 11 and the outer concentric flow path in pipe 9.

Significantly, the RF radiation will be preferentially absorbed by the solid organic matter or kerogen, so as to create in the preferred 360 degree full arc of distributed microwaves, a continuously expanding ring of organic matter heating around the entire circumference of the bore hole 7 at the level of the oil shale bed being worked. The radial distance this energy is absorbed from the microwave source 12 as center in the bore hole 7 is relatively substantial as noted hereinafter.

However, when the maximum practical distance is reached, which is indicated by the fact that oil production, i.e. the vaporized and gasified organic constituents, e.g. including gasified residual solid carbon or coke, from a particular bed drops significantly, radiation is discontinued and the production of the operation is terminated.

Such drop in production is a direct measure of the fact that the RF energy penetration has reached its practical maximum distance of heating effectiveness, and in turn that the production limit for that oil shale bed from that bore hole 7 has been reached.

This maximum radial distance from the borehole, up to which microwaves will penetrate through the oil shale and by selective heating in turn cause the organic materials present to be released or emitted from the rock or mineral matrix in practical quantities, is normally called the recapture radius. This recapture radius is a direct function of the microwave power input, and thus may be selectively increased by correspondingly increasing the level of microwave power applied to the formation After the final products have been removed from the bore hole via the pipe 9, the production equipment, including the unit 11, is pulled from the bore hole 7, the bore hole is plugged just beneath the next oil shale bed thereabove, as earlier described, and the production operation repeated until all oil shale beds in turn are developed or worked from the same bore hole 7.

When the oil production from the last or uppermost oil shale bed has been completed, the production equipment, including the unit 11, is withdrawn permanently and the bore hole 7 is surface sealed in conventional manner to minimize post development or post extraction environmental effects of the production operation. Then, the entire operation may be repeated at the next bore hole.

During production of a given oil shale bed, the oil vapors, water and noncondensible as may be under sufficient autogenous internal pressure as created by the RF energy heating to cause these constituents to drive themselves via the pipe 9 to the surface 2, or surface pumping may be required in conventional manner, depending on the nature of the carbonaceous material and the type and condition of the oil shale bed, as well as upon the temperature to which the constituents are heated and the point in time and/or proximity to the outer limit of the recapture radius of the particular operation.

In any case, as aforesaid, the radiation zone within the bore hole 7 and the pipe 9 at the level of the oil shale bed being worked is isolated by the inflatable collar 10 or other removable packer, in conventional manner, and this prevents air in the bore hole 7 thereabove from mixing with the exuding or emitting gases and oil entrained therewith which enter the bore hole 7 from the surrounding oil shale bed. This insures that the in situ microwave radiation pyrolysis is carried out in the substantial absence of air according to the present invention.

On the other hand, at the surface 2, the product stream passing through the cap system 15 is condensed in conventional manner, as in the gas separator 17. In this way, the normally liquid oil constituents and attendant water are condensed from the non condensible gas constituents, enabling the latter to be separated via line 20 and passed to the gas holder 21 for further work up, e.g. stripping any attendant hydrogen sulfide from the gas in the usual way to remove this undesirable noxious constituent (by means not shown), prior to use of such recovered noncondensible gas.

Advantageously, according to the present invention, at least a portion of the remaining gases after such work up is desirably used to generate power for operating the microwave generating or distribution source 12. For this purpose, such gases are fed via line 24 from the gas holder 21 to the electric generator 22, which may be a conventional gas operated generator or fuel cell (e.g. 1-KW Raytheon).

Under the prevailing or selectively adjusted pyrolysis conditions, the noncondensible gas produced from the operation will normally provide sufficient available energy at least to support the power requirements of the microwave generating source 12 and collateral surface equipment as well.

As to the normally liquid oil constituents and condensed attendant product water which accumulate in the gas separator 17, these may be passed via oil line 18 to the holder 19, where the oil may be readily separated from the product water in conventional manner, e.g. by phase separation, and re-covered as a commercially useful oil product, i.e. shale oil.

Alternatively, the gas separator 17 or other auxiliary means (not shown) may be operated to cause the condensed product water to settle as a bottom liquid phase under and upper liquid phase of the condensed oil vapors, enabling the latter to be suitably tapped off by phase separation technique via oil line 18, while the noncondensible gas is recovered via gas line 20 as before. In this case, the product water will be separately tapped off via a bottom line (not shown) from the gas separator 17 or such other auxiliary means.

In any case, the separated product water may be disposed of in any convenient manner, such as by disposal in an evaporative tailing pond, whereas the produced oil will normally require some clean up before marketing, since it will generally contain nitrogen plus other factors or constituents which should be removed, as the artisan will appreciate.

On the other hand, any potable water requirements may be met in the field by simply sinking a water well in the vicinity of the operation, since in the usual instance the formation will contain an artesian aquifer or water bearing stratum about 200 feet below the shale beds from which fresh water is readily obtainable. These potable water requirements, of course, only concern those for personal use since, except for optional cooling of operating equipment, the process of the present invention requires no water, which is a significant environmental and economic advantage.

More important, the product water obtained is not extraneous to the region but represents a constituent indigenous to the very formation being worked and is extracted from oil shale strata originally overlying the pre-existing pure water in the artisian aquifer or water bearing stratum normally present about 200 feet therebelow.

Obviously, achievable oil and gas production varies in direct proportion to the radius of RF energy penetration into the oil shale bed from the microwave source 12 in the bore hole 7. To maximize this radius, major RF power must be provided.

On the other hand, the use of such high power initially is not desired because full initial application of such high RF power might lead to detrimental effects upon the immediate area surrounding the bore hole 7, e.g. rapid expansion of the constituents as they pyrolyze, and in turn eventual expansion of the rock or mineral matrix or media itself as the pyrolysis progresses farther into the bed and the hot vaporized and gasified constituents continuously flow under autogenous pressure to that immediate area surrounding the bore hole 7 for recovery via the holes in the unit 11.

This could cause the adjacent areas of the bed to disintegrate, such that collapsing rock portions might trap and/or crush the unit 11, as where no casing 8 is used in the bore hole 7 or where its lower end terminates at some point above the level of the oil shale bed being worked.

It would, in any case, cause fluctuating conditions, detracting from the uniform production rate of oil and gas constituents under the applied microwave power levels, as fundamentally desired according to the present invention.

Hence, it is instead contemplated that the oil production or microwave heating extraction operation be carried out such that variable RF power is selectively applied, e.g. beginning with a lower level of RF power and increasing that level as penetration progresses. In this way, undesirable local overheating of the porous media, e.g. shale, in the vicinity of the bore hole 7 will be avoided. Of course, this avoidance of local overheating will be reinforced by preferred use initially of intermittent interval cycles of on and off duration selective microwave power as noted below.

Commercial production by microwave heating via the borehole technique, requires the drilling of many boreholes, and installation and operation of the pertinent surface and underground equipment at each, in successive manner from the lowermost to the uppermost oil shale bed after preliminary plugging of the borehole portion at the underside of the particular bed next to be worked. Production equipment costs will, of course, decrease sharply as radius production increases, and this depends on the depth of radial penetration of the RF power, and in turn on the maximum efficient level of such power, relative to a given type of oil shale bed.

For instance, generally at a 12 foot production radius, about 48 production boreholes per acre will be required, whereas at a 20 foot production radius, about 17 production boreholes per acre will be required, at a conservative 50% borehole density per acre to prevent overlap with the shale bed portions of the neighboring boreholes at the bed level being worked.

In this regard, since there are 640 acres per sq. mi. or per 27,878,400 ft.$^2$, and thus 43,560 ft.$^2$ per acre (27,878,400/640):

for a 12 foot production radius the area per borehole amounts to 452.57 ft.$^2$ ($12\times12\times22/7$), which at a 50% borehole density corresponds to 48 boreholes per acre ($50\%\times43{,}560/452.57$), and for a 20 foot production radius the area per borehole amounts to 1257.14 ft.$^2$ ($20\times20\times22/7$), which at a 50% borehole density corresponds to 17 boreholes per acre ($50\%\times43{,}560/1257.14$).

Indeed, even at higher borehole densities, since the previously worked neighboring borehole areas of the beds will have been provided with cement plugs 23, any vaporized and gasified constituents at the outer portions of the bed radius then being worked, which may migrate into the radius of an already worked borehole area, will be prevented by such plugs from leaving the distant reaches of the bed and from decreasing significantly in autogenous pressure, such that maximum recovery will still be achieved via the borehole being then used.

This may be aided by suction pumping of such constituents via the outer concentric flow path within pipe 9 in conventional manner (by means not shown).

Concomitantly, because of the plugging along and surface sealing of all neighboring boreholes, undesired access of extraneous air to the site being worked by seepage through the formation from such neighboring boreholes, especially under such suction pumping conditions, will be advantageously avoided.

More important, because of the general impermeability of the unheated perimetric boundaries of the given recapture radius outer limits at each borehole being worked, and the avoidance of overlap among the recapture radius outer limits of neighboring boreholes, the generated gases will be prevented from migrating away from the borehole being worked, norwill any extraneous source of air be able to reach the pyrolysis range thereat from a point beyond such recapture radius.

Regardless of the length of the production radius utilized, it will be appreciated that the oil production rates from each like type oil shale bed along the relatively shallow depth being worked tend to remain fairly constant, e.g. ranging from about 10–15 barrels per day for rich oil shale, under a controlled application of the selected RF energy.

It will be seen that the borehole equipment and surface equipment are recoverable and reusable at the next borehole, except for the upper borehole casing 8 which where used is ordinarily left in place. The operation lends itself to the carrying out in the field of the various surface operation, including gas stripping, hydrogen sulfide extraction, power generation, water removal from the recovered oil, water treatment for disposal, or even reuse for instance in part as closed cycle cooling water for various operating equipment such as the field electrical generator 22, and oil treatment and temporary storage prior to transport for marketing.

Particular environmental advantages of the process according to the present invention, which immediately suggest themselves include:

1. The avoidance of apparent or obvious terrain changes since mining is not used and the boreholes are plugged after use.

2. The ability to strip and recover in the field by conventional means the hydrogen sulfide present in the gaseous fraction of the recovered constituents.

3. The avoidance of disturbance to water aquifers present in the formation being worked since water is not required for carrying out the extraction operation, and at most minimal coolant water is needed which can be recycled in a closed system.

4. Labor requirements are not intensive, but instead are minimal and thus minimize socio-economic impact in the area.

5. The avoidance of surface or air pollution since the pyrolysis decomposition occurs underground, in the absence of air, and the decomposition products are recovered and processed on the surface in a closed piping system, and the commercial products and by products obtained are of no greater risk than those in general, consequent analogous industrial endeavors.

Figure 2A:
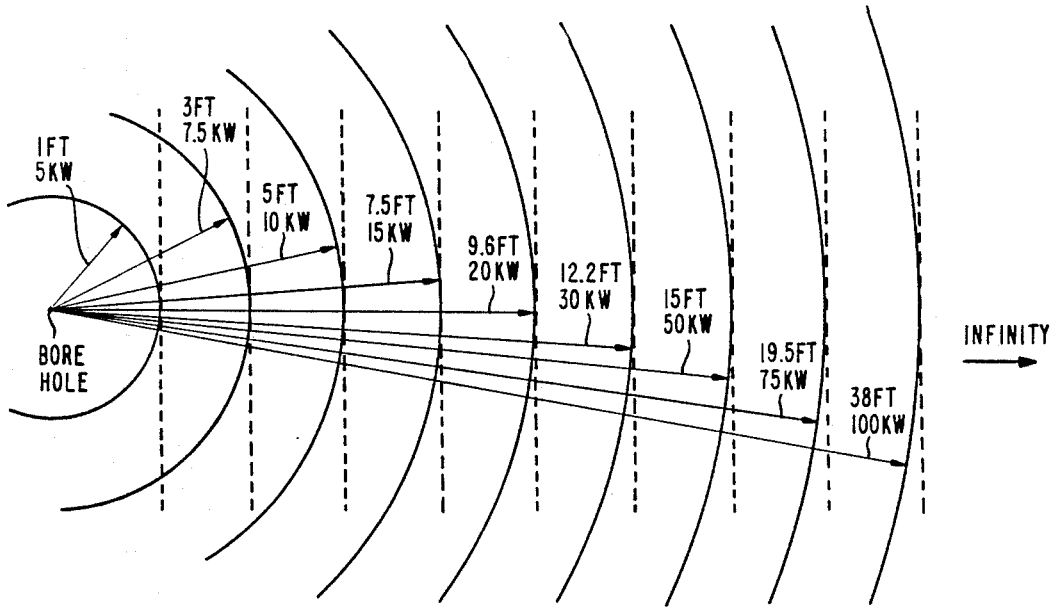
FIGS. 2*a* and 2*b* are companion schematic views, not drawn to scale (i.e. non-scalar), with FIG. 2*a* showing from above portions of successive annular rings of progressively increasing selective, yet nonuniform, increments in feet of radius from a borehole or well bore extending through a stratum of oil shale, and the concordant increments in kilowatts of microwave radiation (RF) associated with the pyrolysis production of oil and gas relative to the annular span of each corresponding ring, and with FIG. 2*b* showing a composite graph of such nonuniform increments in feet of radius (top abscissa) and in kilowatts of microwave radiation (bottom abscissa) as a function of the on and off heating cycle times in seconds of the microwave radiation (left ordinate) and cumulative oil and gas production quantity at an approximately constant production rate (right ordinate and shaded area), plus the progressively increasing pyrolysis temperature at pertinent levels along the non-scalar slope of the straight line intersecting curve defining the boundary of the cumulatively increasing, and approximately constant production rate, pyrolysis generated oil and gas quantity in the shaded area.
Figure 2B:
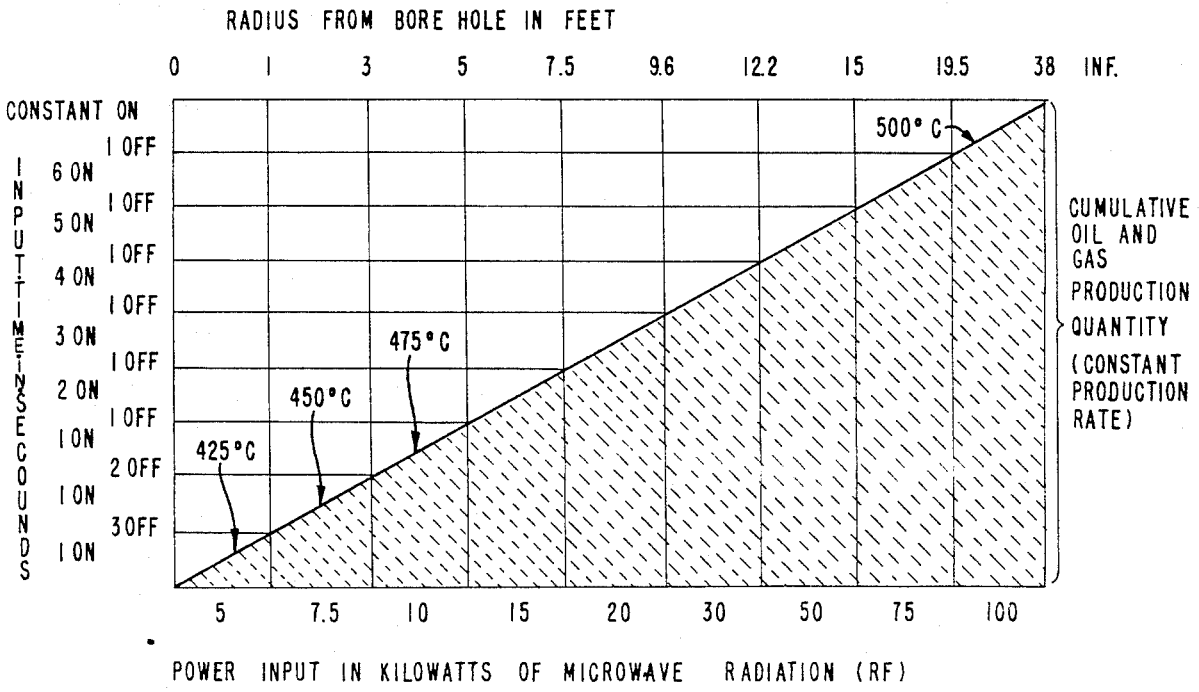

FIGS. 2*a* and 2*b* show conditions under which the microwave radiation pyrolysis of oil shale may be carried out according to an embodiment of the present invention at a formation installation of the type indicated in FIG. 1.

One set of operating parameters, wherein the recapture radius is about 38 feet relative to the borehole 7 at a given oil shale bed or stratum (FIG. 1), and in which the microwave distributing source 12 of the unit 11 is arranged for distributing the RF radiation throughout a full 360 degree arc, is set forth in the following Table 1:

TABLE 1

| Ring | Radius From Borehole | Microwave Power | Heating Cycles Power Intervals* | Total Circular Area |
|---|---|---|---|---|
| 1 | 1 ft. | 5,000 watts | 1 sec. on/3 sec. off | 3.14 f |
| 2 | 3 ft. | 7,500 watts | 1 sec. on/2 sec. off | 28.29 f |
| 3 | 5 ft. | 10,000 watts | 1 sec. on/1 sec. off | 78.57 f |
| 4 | 7.5 ft. | 15,000 watts | 2 sec. on/1 sec. off | 176.79 f |
| 5 | 9.6 ft. | 20,000 watts | 3 sec. on/1 sec. off | 289.65 f |
| 6 | 12.2 ft. | 30,000 watts | 4 sec. on/1 sec. off | 491.07 f |
| 7 | 15.0 ft. | 50,000 watts | 5 sec. on/1 sec. off. | 707.14 f |

TABLE 1-continued

| Ring | Radius From Borehole | Microwave Power | Heating Cycles Power Intervals* | Total Circular Area |
|---|---|---|---|---|
| 8 | 19.5 ft. | 75,000 watts | 6 sec. on/1 sec. off | 1,195.07 f |
| 9 | 38.0 ft. | 100,000 watts | constant on | 4,538.29 f |

*Power/time rates may vary depending upon characteristics of deposit.

Considering the values given in Table 1 with those shown in FIGS. 2*a* and 2*b* it is seen that in the first annular ring of oil shale around the bore hole, the 1 foot radial distance of oil shale is subjected to 5,000 watts (5 KW) of microwave power in input time heating cycles of 1 second on and 3 seconds off duration intervals for heating the annular ring area of 3.14 $ft^2$ (ignoring as relatively insignificant the area represented by the borehole itself), during which time the carbonaceous constituents or carbon content in the porous shale rock or mineral are preferentially heated, relative to the generally microwave transparent and thus not preferentially heated mineral content, such that the carbon content in the first ring progressively heats up to about 425° C.

As the heating progresses in a direction away from he borehole, the next 2 feet of radial distance of the oil shale in the second annular ring along with the 1 foot of the first ring, totaling 3 feet radial distance, is then subjected to 7,500 watts of microwave power in heating cycles of 1 second on and 2 seconds off duration intervals for continued progressive heating of the new 28.29 $ft^2$ cumulative first and second annular ring area, such that the attendant carbon content increasingly heats up to about 450° C. preferentially relative to the mineral content.

In turn, the next 2 feet of radial distance in the third annular ring, along with the previous 3 feet of the first and second annular rings, now totaling 5 feet radial distance, is subjected to 10,000 watts of microwave power in heating cycles of 1 second on and 1 second off duration intervals for further progressive heating of the now 78.59 $ft^2$ cumulative first, second and third annular ring area, such that the attendant carbon content increasingly heats up to about 475° C. preferentially relative to the mineral content.

This progressive and incremental heating of the successive annular rings of oil shale continues in accordance with the conditions given in Table 1 and as shown in FIGS. 2*a* and 2*b*, until the ninth successive annular ring is reached at a recapture radius of 38 feet and embracing a cumulative total oil shale area of 4,538,29 $ft^2$, during which time the microwave power is increased from 75,000 watts in heating cycles of 6 seconds on and 1 second off duration intervals, per the eighth successive annular ring, to constant on power at 100,000 watts (100 KW), such that the attendant carbon content increasingly heats up to about 500° C. preferentially relative to the mineral content.

Of course, these radial distances are not critical, and similar results are obtained where the third ring has a 4.5 ft radius, the fourth ring has a 7.2 ft. radius, the sixth ring has a 12.5 ft radius and the eighth ring has a 20 ft. radius, all at corresponding concordant total circular areas for the 360 degree full arcs of distributed microwaves applied thereto.

Thus, the microwave power is incrementally, though nonuniformly, increased with incrementally, though nonuniformly, increasing radial distance from the borehole and conjointly increasing total circular area subjected to the heating RF energy. At the same time, until the microwave power is switched to constant on duration at the ninth successive annular ring, the heating cycles progressively increase in the duration intervals of on time (power on) and correspondingly progressively decrease in the duration intervals of off time (power off), the on time intervals actually being constant for the first three annular rings at 1 second and then uniformly increasing to 6 seconds for the eighth annular ring, while the off time intervals uniformly decrease from 3 seconds to 1 second for the first three annular rings and remain at the 1 second off time intervals through the eighth annular ring.

As may be appreciated from the shaded area of FIG. 2*b*, during the operation the cumulative oil and gas production quantity progressively increases and this, of course, is a function of the increasing total circular area around the borehole (cf. FIG. 2*a*) being subjected to the microwave heating energy, as listed in Table 1. Indeed, the actual quantity will depend on the width or vertical height of the oil shale bed or stratum being worked, such that for the sake of illustration, the quantity of cumulative oil and gas produced from a 1 foot high bed section being worked will be roughly one tenth that from a 10 foot high bed section being worked, i.e. of the same total circular area or recapture radius.

As also indicated in FIG. 2*b*, the temperature of the carbon content in the bed area being worked progressively incrementally increases as well from a roughly minimum production temperature of about 425° C. at intermittent power eventually to about 500° C. at constant power, the magnitude of such power of course progressively increasing as well, understandably, from a low level of 5 kilowatts to a high of 100 kilowatts.

Nevertheless, under the controlled conditions of progressively increasing power, first at intermittent on and off duration intervals and subsequently at constant on duration or condition, along the radially increasing distance from the borehole, the production rate may be selectively maintained constant, even though the total quantity of produced oil and gas cumulatively increases (cf. FIG. 2*b*).

A similar set of operating parameters, wherein the recapture radius is about 30 feet relative to the borehole 7 at a given oil shale bed or stratum (FIG. 1), and in which the microwave distributing source 12 of the unit 11 is arranged for distributing the RF radiation throughout a full 360 degree arc, analogous to the operating parameters of Table 1 and the features shown in FIGS. 2*a* and 2*b*, is set forth in the following Table 2:

TABLE 2

| Ring | Radius From Borehole | Microwave Power | Heating Cycles Power Intervals |
|---|---|---|---|
| 1 | 1 ft. | 5,000 watts | 1 sec. on/3 sec. off |
| 2 | 2 ft. | 7,500 watts | 1 sec. on/2 sec. off |
| 3 | 3 ft. | 10,000 watts | 1 sec. on/1 scc. off |
| 4 | 5 ft. | 15,000 watts | 2 sec. on/1 sec. off |
| 5 | 10 ft. | 20,000 watts | 3 sec. on/3 sec. off |
| 6 | 20 ft. | 50,000 watts | 3 sec. on/2 sec. off |
| 7 | 30 ft. | 100,000 watts | 3 sec. on/1 sec. off |

For increased production, the recapture radius may be extended, as in the case of Table 1, by continuing the microwave distribution at constant on power at 100,000 watts, after the 30 foot radial distance of the seventh annular ring has been reached.

Of course, higher levels than 100,000 watts of RF power may be used, as and if desired, as the radial distance approaches the outer limits of the recapture radius, depending on the actual shale conditions encountered, as the artisan will appreciate. Nevertheless, a fundamental purpose of the process of the present invention is to maximize recovery of the oil and gas constituents in the particular petroleum impregnated porous media such as oil shale at correspondingly minimum expenditure of RF power.

The RF power may be suitable applied at a frequency ranging, for instance, generally between about 10–2000 M Hz, or more, as desired. This high frequency electrical energy or microwave energy, which is generally in the radar range, is thus capable of being directed into the oil bearing strata considerable distances for accomplishing the pyrolysis extraction of the carbonaceous values present substantially completely throughout, due to the relatively low dielectric loss factor of the petroleum fluids which thereby act to conduct, or transmit, the microwaves rather than to attenuate them.

The advantage of this fact is striking in that the well may be pumped, i.e. the generated liquified and/or gasified constituents passing radially to the microwave unit 11 in the borehole 7 and in turn upwardly through the outlet pipe 9 may be withdrawn by pump means (not shown) at cap system 15 (FIG. 1), as and if needed, at a higher rate with less adverse effect on the transfer of the high frequency electrical energy through the oil and gas constituents in the bedding being worked than otherwise and such is not in any way impaired by gravity.

It will be realized that due to the advantageous preferential or selective heating of the carbon content of the oil shale, and the apparently inherent general transparency of the mineral content thereof to microwaves under the contemplated operating conditions, the total energy expended in providing for the microwave heating of the oil shale for the production of the carbon content thereof as recoverable oil and gas constituents, according to the present invention is significantly less than that required in otherwise retorting the oil shale in situ by conventional means, whether in the presence of contaminating combustion air which consumes a large proportional quantity of such carbon values as direct source for providing the necessary heat, or in the absence of air using an indirect, and thus less efficient, source of heat.

This is because, according to the present invention, the relatively heavy mass of rock constituting the mineral content of the oil shale is not heated to any pertinent extent by the microwaves, whereas the carbon content is selectively inherently heated thereby. Of course, as the oil and gas constituents are generated under the applied microwave heating, a certain amount of indigenous sensible heat taken up by the liquified and gasified constituents of the in situ carbon content of the oil shale will be given up in turn to the surrounding mineral content by direct contact conduction transfer and perhaps also by normal heat transfer radiation.

However, the amount of such heat lost to the mineral content of the in situ rock of the oil shale formation will be substantially less than that imparted thereto per the conventional in situ retorting operation, whether carried out by direct combustion in air or by indirect heating using an extraneous and inefficient indirect heating source, since in the conventional retorting operation the entire mass of the oil shale must be heated grossly, i.e. by bulk heating, with little control, whereas by way of the process of the present invention primarily only the carbon content of such mass is preferentially or selectively heated and in controllable manner.

This differential heat saving is true even considering that energy must be expended in order to provide microwave power for the in situ pyrolysis of the oil shale or other petroleum impregnated porous media according to the present invention, because only a limited portion of the energy otherwise needed is involved in supplying the microwave power.

More important, since inherently due to the make up of the carbon content in the oil shale or the like, a significant quantity of the pyrolysis generated constituents will be in the form of gasified constituents, of which a pertinent portion will necessarily exist as noncondensible gas (which portion may be increased by controlling the pyrolysis conditions according to the process of the present inventiomn), that portion alone may serve as by product energy source for generating the required microwave power without reducing the otherwise primarily sought oil product.

In this regard, the primary form in which the carbonaceous values represented by the carbon content of oil shale exists is kerogen. Oil shale, as aforesaid, may be regarded as a sedimentary rock having a relatively high organic content, i.e. kerogen, which may amount to roughly about 30–60% volatile matter and fixed carbon, such that when appropriately heated in the absence of air it gives up an oil.

Depending on its location, oil shale may yield from 20–50 gpt of crude oil which general possesses a relatively olefinic type unsaturated nature compared to the typical petroleum obtained by drilling methods.

As between microwave or RF heating of kerogen and conventional conductive heating thereof, it will be appreciated that in either case, kerogen must be heated to at least about 425° C. before pyrolysis thereof will occur. Once this threshold temperature is reached, pyrolysis of the kerogen will occur within time periods on the order of one second or less.

Electromagnetic energy in the form of microwaves or radio frequency (RF) waves is quickly radiated into the oil shale, which is, as aforesaid, essentially transparent to RF waves, and upon contact with the RF absorbent kerogen quickly reaches pyrolysis temperature, whereby to carry out the production process according to the present invention.

In contrast thereto, conventional bulk heating methods depend upon the thermal conductivity of oil shale, which is low. Its thermal conductivity is about 0.0017 cal/cm$^3$/sec./°C. and drops to roughly half this value at 425° C.

Thermal conductivity may be regarded as the capacity for conducting heat, e.g. expressed as the number of calories passing per second through a plate of 1 cm$^2$ area and 2 cm thickness and having its opposing faces at a 1° C. differential temperature, or alternatively expressed as Btu/hr/ft$^2$/°F./ft of thickness of a given material.

From the foregoing, it is clear that RF heating of oil shale is significantly faster and thus consumes comparatively low orders of magnitude of energy. Conversely, conventional conductive heating time for bulk heating of oil shale is in the order of hours before pyrolysis can occur.

Typically, dolomite is the largest mineral component in oil shale and occupies only about 21 vol. % of the rock volume, the remainder being other mineral components plus the organic matter. Representative oil shales have the following approximate organic matter and mineral matter volume ratios: 23.5 gpt oil shale—29 vol. % organic matter: 71 vol. % mineral matter 25.0 gpt oil shale—30 vol. % organic matter: 70 vol. % mineral matter 30.8 gpt oil shale—36 vol. % organic matter: 64 vol. % mineral matter 46.2 gpt oil shale—47 vol. % organic matter: 53 vol. % mineral matter.

As regards formation materials, other than the organic hydrocarbon constituents present, which might possibly absorb microwave energy, these generally include the silicates such as quartz, soda feldspar and potash feldspar, and the carbonates such as dolomite and calcite, which make up most of the mineral content in oil shale and which are relatively transparent to microwaves, plus water and prior to its gasification also the residual carbon or coke which remains in solid form after the volatilizable and gasifiable organic constituents have been pyrolyzed.

Water clearly absorbs microwave energy, and is usually present in the formation as compositional water since oil shale beds are generally impervious to ground water. This compositional water, for the most part, exists either as water of crystallization in the associated mineral matter or as clay hydroxyl (OH) type water mostly in the form of analcime, which is the only hydrate normally found in any quantity in the contemplated oil shale deposits.

Analcime, or analcite, e.g. $NaAlH_2Si_2O_7$, may be regarded as an isometric native sodium aluminum silicate zeolite, and its derived water will be volatilized from the analcime crystal under the microwave heating.

Illite clay, which also contains hydroxyl groups, is likewise often present in oil shale along with analcime, and its water content will be released under the microwave heating just as in the case of analcime.

Moreover, iron constituents in the associated mineral content such as pyrites ($FeS_2$) will add to those materials which, to the extent present, will absorb microwave radiation, in the case of pyrites probably leading under the pyrolysis conditions to the reaction thereof with the organic matter present to produce hydrogen sulfide ($H_2S$). Generally, iron also occurs in the ubiquitous dolomite and widespread magnesium iron carbonate called "ferroan", which are usually present in oil shale deposits.

Thus, allowances must be made for absorption of some of the applied microwave energy in driving off water of crystallization and hydroxyl derived forms of water from the associated mineral content in the formation, as well as in the heating of iron constituents such as pyrites and ferroan which may also be present.

Naturally, the amount of RF energy expended in these instances, as compared to that used for extracting the carbonaceous values sought, will vary as the amount of such RF energy absorbing noncarbonaceous constituents varies for a given type formation deposit, and thus the heat loss involved will concordantly vary, but its magnitude will be relatively low compared to the magnitude of RF energy desirably preferentially absorbed by the carbonaceous constituents.

Theoretically, an additional RF energy heat loss may occur by heat transfer to the tiny mineral crystals which are often intimately intermixed with the organic matter in situ in the deposit. The size of this effect is impossible to estimate and to the extent it may exist will similarly vary with the nature of the given deposit.

Because of the relatively low thermal transmissivity of both the organic matter and the mineral matter, the actual heat transfer effect of this possible source of heat loss in the intimate "oil" and "shale" or mineral component mixture, to the extent that it may exist, will necessarily be correspondingly less than that equivalent to bulk heating or gross heating of the mass by way of conduction heat transfer, and may be regarded as minimal or insignificant.

As to the actual mechanism by which the organic matter is extracted during the microwave pyrolysis, it is believed that as the organic matter, such as kerogen in oilshale, is heated by absorption of the microwave energy, its internal bonds begin to break, thereby generating additional excitable sites in the particular molecule, e.g. hydrocarbon, at which more energy is in turn absorbed so that the organic matter becomes fluid, with the process increasing with increasing temperature.

As the temperature rises to the point where the carbon-to-carbon bonds start to break indiscriminately, the absorption rate accelerates markedly until the organic matter is totally decomposed and oil vapor and noncondensible gas are produced.

Because of the way that the radiant energy is applied and because of the slight delay inherently initially imposed by the internal back pressure generated in the pores of the porous media, the volatilization must proceed into the shale or other porous media progressively incrementally from the microwave distributing source.

Consequently, the generated oil vapor and noncondensible gas, because of the huge increase in volume as represented by such constituents in now gasified form within the surrounding pores and their corresponding huge decrease in density, e.g. as compared to solid form kerogen, these gasified constituents will drive themselves out of the rock or shale under autogenous pressure, i.e. in reverse direction to the microwave direction, and thus toward the microwave unit 11 (FIG. 1) in the borehole for eventual recovery.

Hydrogen and methane are the two major fuel gases given off when oil shale is heated and, as earlier noted, these gases in particular assist the oil flow within the shale toward the bore hole due to their high relative volumes.

Once the various constituents are gasified and proceed under autogenous pressure out of the rock, they will stop absorbing further microwave energy, on the one hand because their pyrolysis breakdown has been sufficiently completed to the extent consistent with the microwave energy level applied and the corresponding temperature, and on the other hand because the potential for further absorp[tion of microwaves is reduced as these constituents become converted from solid and/or liquid form to pyrolyzed condensible and/or noncondensible gasified form.

In turn, under the continuous progression microwave heating, in effect the microwaves then excite the next layer of organic matter now exposed by gasification removal of the previous layer. Since shale oil is generally nonhomogeneous in nature, it is not believed that as the organic matter is heated at a given level or frequency, e.g. about 100,000 Hz (0.1 MHz), the liquid oil which forms absorbs the microwave energy at the given frequency, i.e. such that the nonhomgeneous liquid oil would absorb energy at a specific frequency.

Instead, it is believed that any change in absorption rate reflects the change of the constituent makeup of the organic matter from nonhomogeneous to homogeneous nature, as represented by the incipient formation of carbon coke, i.e. residual carbon in solid fixed form which constitutes a uniform material.

Hence, the microwave frequency may be selected for controlling the absorption rate for maximizing the energy absorption at minimum energy expenditure during the course of the pyrolysis operation.

In this regard, it has been demonstrated that the loss tangent (which is an index of the ability of a given material to absorb electromagnetic radiation energy) increase by a factor of 6 as shale richness increases from 10 gpt to 76 gpt.

If the oil yield is used to calculate the volume of the organic matter in the rock, the relationship between the loss tangent and the volume of the organic matter is nearly linear, and this constitutes a strong indication of effective and thus preferential absorption of microwave energy by the organic matter.

As earlier noted, typically 23.5 gpt oil shale contains 29 vol. % organic matter, 25 gpt oil shale contains 30 vol. % organic matter, 30.8 gpt oil shale contains 36 vol. % organic matter, and 46.2 gpt oil shale contains 47 vol. % organic matter, and this is consistent with such nearly linear relationship between the loss tangent and the organic matter volume.

It has also been demonstrated that the energy absorption by the organic matter in the oil shale is fairly constant over a wide range of microwave frequencies, since it has been indicated that the dielectric constant (to which the loss tangent contributes) is relatively stable over such wide range of frequencies.

On the other hand, that the mineral matter in the oil shale has only a limited ability apparently to absorb microwave energy, is indicated by the fact that the nearly linear relationship between the loss tangent and the organic matter volume in the oil shale could not exist if the mineral matter absorbed RF energy radiation to any significant extent As an objective collateral observation, in this regard, it may be noted that the relative transparency of well crystallized silicates and ceramics to microwave radiation is confirmed each time one uses a kitchen microwave oven.

Hence, the preferential or selective absorption of the microwave energy by the organic content to the relative exclusion of the mineral content in the rock is demonstrated in terms of (1) the relative volume of the organic matter in concordance with the gpt yield on heating or retorting, (2) the ability of the organic matter to absorb and be excited by microwave radiation as shown by the rise in the loss tangent with increase in the gpt yield richness of the oil shale, and (3) the conversely limited ability of the mineral matter to absorb microwaves consistent with the showing per point (2).

In fact, it has been shown that there is a marked increase in loss tangent at the contemplated pyrolysis temperatures, and an absorption peak has been detected at these temperatures at about 100,000 Hz, which could only occur from the generation of a new absorbing material. Because of the nonhomogeneous nature of the liquid oil generated by the pyrolysis, such absorption peak would not appear to be explainable by the liquid oil being able to absorb the RF energy at a specific frequency, but instead is consistent with and explainable by the attendant formation of the residual carbon, i.e. in the form of carbon coke, which is a uniform absorption, as earlier discussed.

Since the loss tangent drops off after such absorption peak, which increasing frequency, this provides a means for controlling the microwave energy so that optimum frequency of the RF radiation may be applied for optimum or maximized heating of the residual carbon at minimum expenditure of power per unit time, i.e. in the second step, according to the process of the present invention.

In general, therefore, according to the process of the present invention, volatilization or gasification of the organic matter as oil vapors, water vapors and noncondensible gas, under the contemplated pyrolysis conditions in the first step, will typically remove about 80% of the original weight and 90% of the original volume of the in situ organic matter, e.g. kerogen in the oil shale, assuming that the residual carbon or solid fixed carbon coke remaining after such gasification has a density of 2.

This is consistent with the fact that amorphous elemental carbon has a density around 2, while that of graphite is around 2.25 and that of diamond is around 3.5.

Of course, if the oil shale rock has a continuous phase in it, the contained organic matter will be in continuous phase.

As far as the first step is concerned, as volatilization or gasification of the organic matter proceeds into the rock from the irradiated surface, i.e. in a direction away from the microwave source in the borehole, the incrementally vanishing organic volume will create the continuously growing network of tiny holes in the porous media for inherently providing egress routes for the gases created by organic decomposition and existing under autogenous pressure at the contemplated pyrolysis heating temperature.

Since these gases must flow directly through te microwave radiation, there is little likelihood that the oil vapors can either condense or absorb further radiation energy, but even if such were to occur during travel to the borehole, the resulting recondensed liquid oil constituents would again become centers for further microwave absorption and in turn be revolatilized.

Once the ensuing second step has been carried out to remove or scavenge essentially all of the remaining residual carbon by higher temperature gasification to noncondensible gas form (primarily carbon monozide), the oil shale or other porous media will represent a spent rock containing empty internal spaces, which understandably will have lost some structural strength due to removal of its in situ supporting organic matter, although there will be little if any change in its mineral content integrity in view of the fact that the mineral matter is generally transparent to microwave penetration and will have only experienced minimal heating by way of normal conduction, and possibly also normal radiation (as distinguished from microwave radiation), heat transfer.

Naturally, the remaining strength or residual strength of the porous media will vary inversely with the volume of organic matter initially present in the rock and which has been excavated or removed by the pyrolysis. While this removed volume of organic matter will constitute the primary influence on the strength reduction of the spent porous media or rock, other factors may contribute thereto, and particularly the extent to which mineral reactions also occur during the heating, including loss of compositional water, formation of hydrogen sulfide from pyrites which may be present, modification of other iron constituents in the mineral, etc.

For instance, in shale yielding 20 gpt, organic matter removal leaves a porous or hole ridden rock virtually as strong compressively as the initial rock. Its dolomite framework forms a competent structure. In shale yielding 38–42 gpt, the dolomite framework may be so dispersed by the large collective volume of organic matter that the residual rock after organic removal has virtually no compressive strength. Shale grades in between these two types retain some but not all of their compressive strength on removal of the in situ organic matter.

Ultimate compressive strength of 20 gpt shale perpendicular to the bedding planes in the formation is about 18,000 psi, and for 42 gpt (i.e. 1 barrel per ton) it is about 13,000 psi. Although the residual compressive strength of 20 gpt shale is about 15,000 psi, the roughly 40% volume loss of 42 gpt shale makes precise determination of residual compressive strength thereof impractical. Of course, the intermediate 30 gpt shale will retain some residual compressive strength.

Since generally the apparent failure pressure seems substantially larger than the over burden pressure in the formation, based on extrapolation, the probability is that the residual strength of the average shale encountered, e.g. 30.8 gpt shale, will be adequate after the extraction to provide sufficient overburden support. Consequently, as in known methods for in situ recovery of the carbonaceous values in petroleum impregnated porous media, e.g. using steam or hot water, removal of the organic material, such as kerogen from oil shale, by in situ microwave heating in accordance with the process of the present invention will not affect adversely the remaining crystalline rock, and regardless of the depth of the petroleum containing bedding in the underground formation being worked the petroleum depleted rock should adequately support the land or ground surface without sinking or cave in occurring, and thus without disturbing the ecology in any way from this possible source of undesirable environmental imbalance.

Based on performed tests carried out with oil shale subjected to RF or microwave heating, the kerogen breakdown of constituents upon progressive heating is shown in the following Table 3:

TABLE 3

| | Temperature | Constituents Generated |
|---|---|---|
| Pyrolysis begins: | 425° C. (797° F.) | 85% Oil - 9% Gases - Total 94% |
| | 450° C. (842° F.) | 82% Oil - 11% Gases - Total 93% |
| | 475° C. (887° F.) | 80% Oil - 15% Gases - Total 95% |
| | 500° C. (932° F.) | 75% Oil Vapors - 20% Gases - Total 95% |
| Residual carbon: | 525° C. (977° F.) | Carbon coke gasifies |
| | 600° C. (1112° F.) | Water forms |

It is believed that the water which forms is not so much traceable to bound molecular water in the mineral content of the oil shale, but rather to oxygen present in bound mineral carbonate form in the mineral content which under the high localized heating temperature of 600° C. releases carbon dioxide which reacts with the comparatively rich hydrogen content of the kerogen or its generated organic constituent products, e.g. methane, ethane, etc., to form carbon monoxide and water by way of an undesirable heat consuming endothermic reaction.

To the extent that this may occur, it not only expends the microwave energy unnecessarily, but also consumes valuable hydrogen and carbon, otherwise available as marketable hydrocarbon constituents. Instead, it manufactures in situ, even in the absence of air, not only reaction water of no commercial value and representing a contaminant by-product which must be disposed of, e.g. by way of an evaporative tailing pond, but also more importantly, carbon monoxide as a by-product of comparatively low heat value, along with attendant increased amounts of gas diluting carbon dioxide released from the indigenous mineral carbonate present and not so reacted to form carbon monoxide at such 600° C. temperature.

Hence, by maintaining the distribution of the microwave energy such that the temperature remains below about 600° C., not only is the amount of carbon dioxide released from the indigenous mineral carbonate present in the oil shale suppressed or minimized, but also that reduced amount thereof which is released at temperatures below 600° C. will be less prone to endothermic reaction with the comparatively rich hydrogen content present, e.g. in the hydrocarbon generated oil and gas constituents, such as methane, ethane, etc., to form carbon monoxide and water.

Of course, at such lower temperature, any constitutional water present in the mineral content will be less prone to release as product water than at such 600° C. temperature.

The results of Table 3 particularly show that as the temperature incrementally increases during the progressive microwave heating, the proportion of oil decreases from 85% to 80%, while the proportion of gases increases from 9% to 15% with the total of generated constituents remaining in the range of 93–95%, during the pyrolysis from its initiation at 425° C. to its 475° C. heating stage.

When the temperature reaches 500° C., it is seen that the oil constituents, which up to this point had only liquified, now become vaporized or volatilized, such that the oil is converted or gasified into oil vapors in a further reduced amount of 75%. At the same time, the proportion of generated gases also increases still further to 20%, yet the total of generated constituents remains at 95%.

The gases as shown in Table 3 are those constituents which constitute noncondensible gas (i.e. at ordinary temperature), whereas the oil vapors which are generated or gasified at the 500° C. pyrolysis level are, of course, condensible. Under the autogenous pressure of the gases in the pores of the mineral content of the rock or shale, the attendant hot oil constituents are entrained in the gasified, i.e. condensible and noncondensible gas, constituents at the correspondingly progressively increasing heating temperature, and pass in reverse direction to the microwaves and toward the borehole 7 for recovery via the recovery chamber of the unit 11 and in turn, the outlet pipe 9 (see FIG. 1).

Hence, the set of conditions given in Table 1 and conjointly shown in FIGS. 2*a* and 2*b* will contemplate an oil and gas mixture of constituents conforming to the proportional percentages set forth in Table 3 at the corresponding temperatures. It will be appreciated that inherently by reason of the in situ pyrolysis of the oil shale, in the absence of air, the kerogen produces a significant quantity of noncondensible gas as compared to the quantity of oil primarily sought as marketable commercial product.

As will be again repeated for emphasis, this quantity of noncondensible gas, which represents a necessary by-product of the process, may be advantageously used, according to the present invention, as energy source for operating the electric generator 22 (FIG. 1) for providing the microwave power basic to the overall recovery system. At the same time, this use of the necessarily produced noncondensible gas does not detract from the maximum recovery of the desired liquified oil and/or gasified but condensible gas sought as primary product of the system.

Moreover, since the present invention contemplates maximum extraction of the carbonaceous values in the oil shale, the operation will normally be continued beyond the 500° C. temperature level as contemplated in Table 1 and the conditions as shown in FIGS. 2*a* and 2*b*, by raising the temperature in a second step, after complete conversion in the first step of the liquifiable and gasifiable carbonaceous constituents over the pyrolysis temperature range of 425°–500° C.

For this purpose, without interruption, i.e. to prevent needless loss of heat through conduction to the surrounding mineral content mass, the microwave heating is continued at maximum power, e.g. 100,000 watts, under constant on condition, for gasifying the yet unconverted carbonaceous values still present in the oil shale.

As earlier noted, once the liquifiable oil or petroleum constituents present which liquify at pyrolysis temperatures up to 500° C. have been liquified and the volatilizable or vaporizable or gasifiable oil or petroleum constituents present which gasify at such pyrolysis temperatures have been gasified to condensible and noncondensible gases as the case may be, a valuable remainder content of residual unliquified and ungasified carbon constituents will still exist in the pores of the shale. This remainder content in effect constitutes solid form or fixed carbon or carbon coke, which may be termed residual carbon or residual coke.

As indicated in Table 3, by continued microwave heating in the second step, the residual carbon present in the shale begins to gasify at 525° C. In order to avoid water formation for the reasons discussed above, this second step heating is controlled such that maximum heating temperature remains below about 600° C. The maximum heating temperature will therefore be that temperature below 600° C. at which water formation will be avoided, minimized or suppressed, according to the process of the present invention.

The recovered gasified carbon coke, by reason of the second step higher temperature pyrolysis thereof, i.e. also in the absence of air as in the first step, will likewise necessarily produce noncondensible gas, in this case contributing primarily increased contents of carbon monoxide. This second step noncondensible gas quantity may be advantageously added to that recovered from the first step, and used in whole or in part for operating the electric generator 22 to produce the required microwave energy.

Of course, depending upon the field conditions, the recapture radius and the makeup of the carbonaceous constituents of the particular oil shale involved, the quantity of pyrolysis generated gas from the second step alone may be sufficient to provide the energy for operating the microwave source 12, without the need to use the noncondensible and/or condensible gasified constituents from the first step, or more than a portion of the noncondensible gasified constituents from the first step.

Although the noncondensible gas generated by gasification of the residual carbon coke in the second step will be comparatively enriched in carbon monoxide content, such is still a significant fuel source for energizing the electric generator 22.

Naturally, if it is desired to maintain these different gasified portions separate from each other, the gas line 20 from the gas separator 17 (FIG. 1) may contain one or more branch lines leading to correspondingly separate gas holders analogous to gas holder 21, such that the gas recovered via pipe 9 from the first step may be transferred to one such gas holder and that recovered via pipe 9 from the second step may be transferred to a different such gas holder.

EXAMPLE 1

Energy Inputs and Production Outputs (30 gallons per ton oil shale)

Based on an oil shale grade of about 30 gpt on Fischer assay, typical of the average shale grade in the State of Wyoming, the 30 gpt oil shale had the following characteristics:

Density 2.145 gm/cc

Organic Matter 17.4 wt. %; 34.8 vol. %

Mineral Rock 82.6 wt. %; 65.2 vol. %

Converting the density to 133.9 lb/ft$^3$ (i.e. 2.145 gm/cc×62.4 lb/ft$^2$ water density), the weight of the organic matter, i.e. kerogen, and mineral rock in 1 ft$^3$ of such oil shale, comes to about:

Organic Matter 23.3 lbs. (i.e., 133.9×17.4%)

Mineral Rock 110.6 lbs. (i.e., 133.9×82.6%)

On a 1 ft$^3$ shale basis, on heating in Fischer assay, the 23.3 lbs. of organic matter converts to about 15.32 lbs oil and about 1.8 lbs. residual coke, the remainder being about 2.7 lbs. water and about 3.5 lbs. noncondensible gas (i.e. noncondensible at ordinary ambient temperature).

The 3.5 lbs. noncondensible gas produced with the 15.32 lbs. oil weighs about 23% of the oil product (3.5/15.32)in the 23.3 lbs. of organic matter and has the approximate composition as shown in the following Table 4:

TABLE 4

| Gaseous Component | Noncondensible Gas Composition Mol. Wt. | × | Vol. % | = | Mol. Fraction |
|---|---|---|---|---|---|
| Methane | 16 | | 20.0 | | 3.20 |
| Ethane | 30 | | 7.0 | | 2.10 |
| Propane | 44 | | 3.3 | | 1.45 |
| Butanes | 58 | | 1.9 | | 1.10 |
| Pentanes | 72 | | 1.1 | | 0.79 |
| Ethylene | 28 | | 2.8 | | 0.78 |
| Propylene | 42 | | 3.0 | | 1.26 |
| Butenes | 56 | | 1.2 | | 0.67 |
| Pentenes | 70 | | 2.1 | | 1.47 |
| Hexenes | 84 | | 1.5 | | 1.26 |
| Butadienes | 54 | | 0.1 | | 0.05 |
| $CO_2$ | 44 | | 12.9 | | 5.68 |
| CO | 28 | | 5.5 | | 1.54 |
| $H_2$ | 2 | | 33.5 | | 0.67 |
| $H_2S$ | 34 | | 4.1 | | 1.39 |
| | | | 100.0% | | 23.41 Apparent Mol. Wt. |

It will be noted that the predominant quantity of hydrocarbon constituents are of the hydrogen rich saturated type, mainly methane, and that in addition to hydrogen and hydrogen sulfide, a significant content of carbon dioxide, along with some carbon monoxide, is also present.

The apparent mol. wt. 23.41 of the 3.5 lb. product gas indicates that 54 ft$^3$ (STP, i.e. 0° C. or 273° A; 760 mm Hg) of noncondensible gas are produced from 1 ft$^3$ of the 30 gpt oil shale. This converts as follows:

At the underground formation conditions (30° C. or 303° A; 580 mm Hg):

about 78 ft$^3$ non condensible gas (i.e. by the gas law: (54×760/580×303/273);

At the microwave heating or pyrolysis emission temperature (500° C. or 773° A):

about 200 ft$^3$ noncondensible gas (i.e. by the gas law: 78×773/303).

On the other hand, the oil product, which has an average mol. wt. of 240, as volatile material at the 500° C. emission temperature or pyrolysis temperature occupies about 85 ft$^3$ as volatile oil.

The 2.7 lbs. water also produced from the 1 ft$^3$ of oil shale (about 2.0%, i.e. 2.7/133.9) occupies about 53 ft$^3$ (STP), and at the underground formation pressure (580 mmHg) and emission temperature (500° C.), this volume converts to about 200 ft$^3$ of water vapor.

Based on the calculation that the organic matter in the shale requires 527 Btu/lb to heat up and volatilize (per E. W. Cook, 1970, Colorado School of Mines Quarterly, Vol. 5, No. 4, pp. 133–140), the total heat required to heat the 23.3 lbs. of organic matter in 1 ft$^3$ of the shale amounts to 12,250 Btu (i.e. 527×23.3). Since 1 British Thermal Unit equals 0.2930 watt hour, the no-loss RF (microwave) energy required to decompose and volatilize the organic matter in 1 ft$^3$ of the shale (i.e. neglecting any loss to the mineral rock) amounts to 3.6 KW-hr (i.e. 12,250×0.2930/1000 watts).

The 23.3 lbs of organic matter of 34.8 vol. % of the 1 ft$^3$ of the 30 gpt shale of 133.9 lbs/ft$^3$ density will in turn yield about 2.0 gal. of oil product (i.e. 133.9×30/2000 lbs.)

Of course, if accompanying mineral heating including analcime dehydration is considered as occurring, this might require increasing the amount by roughly 2 times as much equivalent heat to the bulk heating (totaling 3-fold heating), whereupon the energy input required to drive out such 2.0 gals. of oil product from the 1 ft$^3$ of shale increases to about 11 KW-hr (3.6×3 fold).

Analcime heat effect on this amount is considered to be less than 5% maximum, so that its presence does not require expending significantly more RF heat energy, especially since the organic matter is heated up by the microwaves preferentially relative to the mineral content of the shale.

Hence, at 11 KW-hr of expended RF energy per 1 ft$^3$ of the underground formation, allowing for bulk heating, the oil production rate (at a theoretical 100% oil recovery) may achieve about 2 gals. of oil product and about ½gal. of water per hour.

However, considering that, as distinguished from bulk heating, the organic matter is heated preferentially relative to the mineral content, according to the process of the present invention, the actual production rate of such 11 KW-hr energy input will be correspondingly higher, reaching 6 gals. of oil product plus 1 gal. of water per hour (at such 100% theoretical oil recovery rate), i.e. based on the fact that the mineral matter does not heat up until after the organic matter has volatilized.

In summary, based on a 30 gallon per ton yield on Fischer assay, the following weights and volumes of products are produced from 1 cubic foot of the oil shale:

| | Weight |
|---|---|
| Oil | 15.3 pounds |
| Water | 2.7 pounds |
| Gas | 3.5 pounds |
| Residual Carbon | 1.8 pounds |
| | 23.3 pounds organic matter (and water) |
| | Volume (500° C., 580 mmHg)* |
| Oil | 85 cubic feet |
| Water | 200 cubic feet |
| Gas | 200 cubic feet |
| | 485 $ft^3$ organic matter (and water vapor) |

*Pyrolysis conditions at underground formation pressure, such that the 1.8 lb. residual carbon is not gasified but only the 21.5 lbs. of oil, water and gas (i.e. 23.3 less 1.8).

Upon recovery and condensation of the volatilized oil and water content, the noncondensible gas volume in turn amounts to 78 $ft^3$ (580 mmHg).

Understandably, these amounts must be adjusted for the particular grade and minerology of the shale encountered. For instance, attendant mineral derived water might add 25% to the amount of water which must be accommodated, and should mineral carbonate decomposition occur, e.g. from attendant ferroan or dolomite, the gas volume might increase roughly 15% due to additional carbon dioxide generation.

It will be appreciated that the time rate of vapor or gas production is a function of the RF energy input as modified by any mineral absorption, such that the maximum amount of organic decomposition products will increase with increasing power input. Ultimately, the balance between organic and mineral absorption of the RF energy under the particular field conditions encountered will control the rate of organic matter recovered as compared to energy supplied at the pyrolysis site.

Generally, such mineral absorption of microwave energy is limited only to pyrites ($FeS_2$), analcime and illite clay, all of which will normally involved at most relatively small quantities, and thus which will actually only add a minor amount to the RF energy needed to carry out the extraction operation according to the process of the present invention.

Thus, at a rate of 3.6 KW-hr RF energy supplied to the rock site, it will take between one and three hours to evolve the above calculated 485 $ft^3$ of total gas (volatiles) available from 1 $ft^3$ of the stated type oil shale at the 500° C. pyrolysis temperature and after cooling to 30° C., the noncondensible gas will occupy 78 $ft^3$ as above noted. Of course, it is only upon the loss of heat into the surrounding mineral content at the pyrolysis site that this time range would stretch out to the maximum or upper limit of three hours.

The foregoing, of course, presumes that the 1.8 lbs. of residual carbon is not gasified, and that the 485 $ft^3$ of generated volatiles or gasified constituents is based upon the 15.3 lbs. oil, 2.7 lbs. water and 3.5 lbs. gs, totaling 21.5 lbs., pyrolyzed at 500° C. from the 1 $ft^3$ of the stated 30 gpt oil shale.

In recovering the emitted or generated volatilized organic matter, the gas flow which is received in the recovery chamber of the microwave unit 11 in the borehole 7 must pass upwardly to the ground surface 2 through the outlet pipe 9 (FIG. 1). The velocity of this flow of gas volume into the pipe 9 is dependent on the rate of production of the vapors or gasified constituents from the oil shale formation, their temperature, and the flow cross sectional area of the pipe 9.

Using a 4 inch radius pipe for this purpose (pipe 9), thereby providing a flow cross sectional area of 0.35 $ft^2$, about 8 $ft^3$ per minute (i.e. 485/60) of hot gases weighing about 0.36 lb. (i.e. 21.5/60) will pass through the pipe per 1 $ft^3$ per hour of the so pyrolyzed or heated shale. This gas velocity is equivalent to a "gale" wind speed of about ¼ mile per hour through the 4 inch radius pipe (i.e. $8\times60/0.35\times5280$).

Alternatively, using a 3 inch radius pipe, thereby providing a comparatively reduced flow cross sectional are of only 0.196 $ft^2$, such flow velocity increases by about 1.8 times (i.e. 0.35/0.196).

The gas separator 17 must therefore be sized to accommodate such flow volume and flow rates of emitted product.

Naturally, in the shale itself, decomposition of the organic matter will develop pores resulting from the disappearance of the organic volume by volatilization, save for the residual carbon still in situ in the rock, and such pore volume will exist to the indicated extent of disappearance of about 90% of the organic volume originally present, which as earlier noted in 30 gpt oil shale originally occupies 34.8 vol. % of the rock. The void spaces so developed accordingly represent about 31% of the rock volume (i.e. $34.8\times0.90$).

Considering the entirety of the void space as available for gas transmission from the rock, 1 $ft^3$ of 30 gpt shale provides about 0.3 $ft^2$ of continuous void area to enable the evolving gases to be discharged from the rock. The flow rate of these evolving gases will accordingly be equivalent to that between a 3 inch to a 4 inch radius outlet pipe 9.

However, because the pores or holes in the rock are very tiny and the resulting passages or routes therethrough are tortuous, only part of this flow area will normally be effective as a practical matter. As a consequence, internal pressure buildup at the decomposing organic face will occur which will inherently serve advantageously to increase the flow rate through the effective flow area of the collective pores of the shale.

In sum, since the gas evolution rate is a direct function of the power input, the greater the effective power in, the more gas out. Generally, the energy input will be progressively increased as decomposition proceeds deeper into the formation from the borehole.

As compared to initially applying the RF energy in increasing increments of power as a function of the total shale under treatment, the applying of RF energy by continuous input of steady or constant level power, with a view to attaining a production rate of evolving vapors which remains nearly the same throughout, is actually subject to decrease in the production rate despite the steady level of power due to mineral, or even perhaps residual carbon, absorption concomitantly increasing as the length of the mineral or rock path increases in a direction away from the bore hole. Hence, the use initially of incrementally increasing power is desirable.

EXAMPLE 2

Gas Energy Balance (25 gallons per ton oil shale)

Organic matter in 25.16 gpt oil shale (which consists of 14.6 wt. % organic matter and 85.4% mineral matter), upon normal bulk heating, produces 2.95 wt. % noncondensible gas, of which about 0.74 wt. % is $CO_2$ unavoidably formed from mineral carbonate decomposition, and thus not traceable to the organic matter. With RF heating according to the process of the present invention, this mineral carbonate decomposition is largely eliminated.

Therefore, upon normalized distribution recalculation to eliminate such mineral carbonate decomposition $CO_2$ fraction, the organic matter is indicated to produce about 2.21 wt. % noncondensible gas (with appropriate $CO_2$ reduction), and about 0.482 wt. % $CO_2$ as shown, based on a 100 gm sample of 25.16 gpt oil shale, in the following Table 5:

TABLE 5

Gas Distribution Normalized To Remove Mineral Carbonate

| Gaseous Component | From 100 gm Shale Sample | wt. % Organic Gas |
|---|---|---|
| Methane | .324 | 44.7 |
| Ethane | .190 | 8.6 |
| Propane | .132 | 6.0 |
| Butanes | .102 | 4.6 |
| Pentanes | .077 | 3.5 |
| Ethylene | .066 | 3.0 |
| Propylene | .110 | 5.0 |
| Butenes | .072 | 3.3 |
| Pentenes | .129 | 5.8 |
| Hexenes | .109 | 4.9 |
| Butadienes | .006 | 0.3 |
| $CO_2$ | .482 | 21.8 |
| CO | .173 | 7.8 |
| $H_2$ | .068 | 3.1 |
| $H_2S$ | .124 | 5.6 |
| $NH_3$ | .043 | 2.0 |
| | 2.207 gms | 100.0% |

Thus, as compared to 0.324 gm methane which, as normalized, constitutes 14.7 wt. % (i.e. 0.324/2.207) of the total gas from the 100 gm sample, the normalized 0.482 gm $CO_2$ constitutes 21.8 wt. % (i.e. 0.482/2.207) of the total noncondensible gas.

This $CO_2$ content, along with the CO content, may be explained in part by the fact that attendant water under the pyrolysis conditions undergoes a reaction with the carbonaceous constituents present, such as methane, so as to form these two carbon oxides.

Such 2.207 gms of noncondensible gas in the 100 gm sample of 25.16 gpt oil shale is, of course, a part of the total 14.6 gms of organic matter present in the shale (14.6 wt. % organic matter and 85.4 wt. % mineral matter), and based on the normalized values of Table 5, the corresponding breakdown in wt. % and mol. fraction of the noncondensible gas in 1 wt. % of the organic matter is shown in the following Table 6:

TABLE 6

Gas Breakdown Per 1 Wt. % Organic Matter

| Gaseous Component | Mol. Wt. | Gas Content In 14.6 g Organic In 100 gm of 25.16 gpt shale | Wt. % Gas From 1 Wt. % Organic Matter | Mol. Fraction From 1 Wt. % Organic Matter |
|---|---|---|---|---|
| Methane | 16.04 | .324 | .0223 | .001390 |
| Ethane | 30.1 | .190 | .0130 | .000432 |
| Propane | 44.09 | .132 | .0090 | .000204 |
| Butanes | 58.1 | .102 | .0070 | .000120 |
| Pentanes | 22.15 | .077 | .0053 | ..000073 |
| Ethylene | 28.15 | .066 | .0045 | .000160 |
| Propylene | 42.08 | .110 | .0075 | .000178 |
| Butenes | 56.1 | .072 | .0049 | .000087 |
| Pentenes | 70.13 | .129 | .0088 | .000126 |
| Hexenes | 86.2 | .107 | .0074 | .000086 |
| Butadienes | 54.1 | .006 | .0004 | .000007 |
| $CO_2$ | 44.01 | .482 | .0331 | .000752 |

TABLE 6-continued

Gas Breakdown Per 1 Wt. % Organic Matter

| Gaseous Component | Mol. Wt. | Gas Content In 14.6 g Organic In 100 gm of 25.16 gpt shale | Wt. % Gas From 1 Wt. % Organic Matter | Mol. Fraction From 1 Wt. % Organic Matter |
|---|---|---|---|---|
| CO | 28.01 | .173 | .0118 | .000421 |
| $H_2$ | 2.02 | .068 | .0047 | .002327 |
| $H_2S$ | 34.08 | .124 | .0085 | .000249 |
| $NH_3$ | 17.03 | .043 | .0029 | .000170 |
| | | 2.207 gm | .1512% | .006782 |

Thus, as compared to 0.0223 wt. % methane in 1 wt. % organic matter based on 0.324 gm methane in 14.6 gm organic matter (i.e. 0.324/14.6), which constitutes a mol. fraction of 0.001390 methane (i.e. 0.0223/16.04), the $CO_2$ content amounts to 0.0331 wt. % (i.e. 0.482/14.6), which constitutes a mol. fraction of 0.000752 $CO_2$ (i.e. 0.0331/44.01). The total 2.207 gm noncondensible gas amounts to 0.1512% (i.e. 2.207/14.6) for a cumulative mol. fraction of 0.006782 for all of the noncondensible gases taken collectively.

Since the organic matter is peferentially heated by the RF radiation, about 125 cal/gm is indicated as required to heat the 25.16 gpt oil shale from the formation temperature (30° C.) to at least 450° C. This includes about 14 wt. % organic matter yet requires only about 28% of the total heat or about 35 cal/gm (i.e. 125×28%). Allowing liberaly for an equivalent heat loss to the mineral matter using RF heating, as an extra one fold amount to compensate for conduction heating and even direct mineral absorption, the total two fol heat required is still only 70 cal/gm (i.e. 35×2 fold).

It is indicated that the preferential absorption of the microwave energy by the organic matter remains fairly constant over a wide range of frequencies (RF), whereas the mineral matter, e.g. carbonates (dolomite, calcite and the like), silicates (quartz, soda feldspar, potash feldspar and the like), aluminates, etc., is relatively transparent thereto throughout such range.

The heat from the above specified noncondensible gas evolved from 1 gm organic matter in the 25.16 gpt oilshale is shown in the following Table 7:

TABLE 7

Heat From Gas From 1 Gm Organic Matter

| Gaseous Component | K Cal | | 70 cal/gm Distribution | |
|---|---|---|---|---|
| Methane | .293 | | | |
| Ethane | .159 | | | |
| Propane | .107 | | | |
| Butanes | .083 | | | |
| Pentanes | .006 | | | |
| Ethylene | .053 | | | |
| Propylene | .087 | | | |
| Butenes | .057 | | | |
| Pentenes | .102 | | | |
| Hexenes | .083 | | | |
| Butadienes | .004 | | | |
| | 1.034 | Subtotal Hydrocarbons | 52.6 | Hydrocarbons |
| $CO_2$ | None | | None | |
| CO | .029 | | 2.3 | |
| $H_2$ | .135 | | 10.8 | |
| $H_2S$ | .036 | | 2.9 | |
| $NH_3$ | .018 | | 1.4 | |
| | 1.252 | K Cal/Gm Organic (in gas from 1 gm organic) | 70.0 | cal/gm |

The heat from the noncondensible gas evolved from 1 gm of organic matter in the shale as shown in Table 7, of course, does not include $CO_2$ since this is already in completely combusted condition.

It will be seen that the total heat of 1.252 K Cal (or 1252 cal) available from the noncondensible gas from 1 gm of organic matter corresponds to 2254 Btu/lb organic matter (i.e. 1.252×1800 where 1.8 Btu/lb. equals 1 cal/gm and 1800 Btu/lb. equals 1 K Cal/gm), and that the total heat available from combustion of the evolved gas is 14% of 1252 cal, or 175 calories.

Based on a 40% conversion efficiency of the combustion energy of such noncondesible gas to produce the RF power in the electrical generator 22 (FIG. 1), such as a gas operated fuel cell, the heat available as RF power from the gas evolved from the organic matter in 25.16 gpt shale is 70 cal/gm (i.e. 175×40%).

Converting the 70 cal/gm to 126 Btu (i.e. 70×1.8), and considering that at 25 gpt oil shale rates it takes 3360 lbs of oil shale to yield a barrel of oil (i.e. 42×2000/25 at 42 gal/bbl) at 100% recovery, then assuming recovery is only 50%, the doubled energy requirement amounts to 846,720 Btu/bbl (i.e. 126×3360×2).

Since 1 kilowatt hour equals 3413 Btu, it will take 248 KW-hrs. or 10⅓ days (24 hour days) to produce 1 bbl of oil (i.e. 846,720/3413). However, if the RF radiation is increased to 10,000 watts (10 KW-hrs), it will take only 24.8 KW-hrs or 1⅓ days to produce 1 bbl of oil, and if the radiation power is increased to 100,000 watts (100 K), it will take only 2.5 K-hrs to produce 1 bbl of oil or 9.6 bbls per 24 hour day (i.e. 24/2.5).

Of course, as will be appreciated, at increased radiation, the yield rate will increase by 2% per 1% increase (at assumed sensitivity to recovery rate of 50%), whereas at decreased radiation, the yield rate will correspondingly decrease by 2% per 1% decrease.

Naturally, depending on the proportion of the created gas which is used to provide power in the electrical generator 22, excess power so produced can be made available to local municipalities or otherwise marketed as a separate product.

As to the composition of the products volatilized or gasified by the microwave radiation pyrolysis of the oil shale or other porous media, and in turn the amounts of the condensible oil (vapors) and noncondensible gas generated, these will vary markedly with the heating rate. Very slow heating produces high conversion of the organic matter to oil, and the oil is primarily paraffinic. Conversely, very rapid heating produces low conversion of the organic matter and generates a primarily aromatic oil. Practical optimum time rates for heating by RF energy are selectively between these two extremes, yet such must be matched to a practical production rate at a total heat balance for the system which is best from a process economics standpoint.

Sine organic matter absorbs RF radiation faster as it becomes hotter, continuous radial progression of organic decomposition to the outer limits of th e recapture radius will be enhanced.

By providing an optimumly by steep thermal gradient across the heating front in the porous media, the organic matter at the reacting front will volatilize before significant thermal expansion will occur of the organic matter behind the reacting front, i.e. in a direction more remote from the microwave source, and this effect may be controlled by controlling the local rate of heating of the organic matter.

In this way, the mechanical behavior of the rock will represent a minimum variable since it varies with the heating rate and the largest influence thereon stems from the thermal expansion of the organic matter.

Hence, by controlling the local rate of heating of the organic matter, such thermal expansion of the organic matter will be confined to the reacting front and will minimize conduction heating of the rock itself and adverse modification of its mechanical behavior and loss of compressive strength, thereby minimizing adverse environmental impact on the underground formation and any ramifications thereof on the integrity of the terrain at the ground surface.

It will be appreciated that corresponding results are analogously attainable in microwave heating of oil and tar sand deposits, heavy oil reservoir deposits, and residual heavy oil pools previously subjected to primary oil well drilling extraction, and the like, in accordance with the process of the present invention.

This is because the applied high frequency electric energy in the form of microwaves quickly transfers through an within the particular deposit of the petroleum impregnated porous media or pool and converts very rapidly to heat energy upon contact with the carbonaceous material present, e.g. hydrocarbon molecules.

Unlike the disadvantageous use of hot water or steam heating in which there is inherently a major Btu loss due to heat dissipation along the downhole course between the ground surface steam generator or hot water heater and the deposit to be heated in situ in the underground formation, in some deposits representing many thousands of feet of vertical separation, there is no corresponding Btu loss between the ground surface and the deposit being worked according to the process of the present invention because the in situ heating is carried out with RF energy heat generated immediately adjacent the deposit at the underground level of the bedding.

Moreover, because of the nature of the microwave heating, just as the organic matter, i.e. kerogen, is thermally broken down into liquid and gaseous constituents, and especially into noncondensible gas by the pyrolysis, bitumen fractions such as those present in oil and tar sands and in heavy oil reservoir deposits and residual heavy oil pools, and the like, will by analogy be similarly broken up to reduce the bitumen into smaller fractions, i.e. smaller molecules.

In this regard, while conventional downhole heating methods which rely solely on heat conduction by bulk heating or gross heating are beset with the complicating problem in dealing with the heavier crudes (which require most of the heating because they are the poorest type of thermal conductors among the crude oils), of expending even greater amounts of heat energy in order to extract them, such complication does not arise according to the process of the present invention because of the manner in which the pyrolysis heating is carried out using microwave energy for molecular breakdown of the carbonaceous constituents in situ.

A more important advantage of the process of the present invention is that the microwave heating of the petroleum impregnated media, such as oil shale, oil and tar sands, heavy oil reservoir deposits, residual heavy oil pools, etc., and specifically of the kerogen, tar, bitumen, heavy crude oil and the like sources of the desired synthetic fuel or "oil", provides for the inherent generation of large volumes of gas, especially noncondensible gas, under the pyrolysis conditions, which gas is primarily derived from depolymerization or molecular breakup or in situ "cracking" of the oil constituents. This molecular breakup is inherently promoted as the autogenous pressure progressively increases with increasing generation of gaseous constituents.

Such is in addition to the role of the generated gas as an in situ drive factor under the attendant autogenous pressure to encourage the oil constituents, including nay liquid oil constituents plus oil vapors admixed and entrained therewith, to migrate towards the borehole for efficient recovery via the microwave unit 11, where once recovered, it represents a convenient by-product usable to produce electrical energy in the electrical generator 22 without decreasing the amount of primarily sought oil as basic commercial product of the endeavor.

As to the migration of the generated oil constituents from the deposit to the borehole, it has also been found that the microwave energy during the pyrolysis specifically breaks down the paraffin content and similar accumulations present in the deposit which otherwise severely retard the normal migration of the oil constituents through the formation in carrying out conventional in situ retorting or heating recovery techniques.

Added to this is the further fact that movement of the oil constituents in the desired migration flow is supplemented or further enhanced by the reduction of the surface tension within the oil constituents by the applied microwaves.

In connection with the foregoing, it should be noted that paraffin constituents are not highly reactive to RF heating. However, the paraffin constituents are conveniently heated by way of molecular conduction by the otherwise RF heated hydrocarbon constituents present in association therewith in the petroleum impregnated media involved during the production operation.

Advantageously, according to the present invention, a time domain technique may be used for the measurement of the dielectric properties or permittivity or inductivity of the petroleum impregnated porous media or deposit such as oil shale, over a broad frequency band of the RF energy within very short time intervals. The measured dielectric properties in turn will provide an indication of the ongoing chemical changes which occur during the pyrolysis decomposition of the carbonaceous values, e.g. hydrocarbons in kerogen in the oil shale, for monitoring and controlling the microwave radiation input as the pyrolysis operation progresses.

In general, the dielectric properties of oil shale, for instance, may be measured using the known point by point frequency domain method. Such a procedure has significantly limited the adequacy of the measurements to track fast or abrupt chemical changes occurring during the rapid heating of oil shale, e.g. using RF heating, although a particular recent technique has been suggested which provides the permittivity behavior over a broad frequency band from a single measurement (*Proceedings of the IEEE,* March, 1981, M.F. Iskander, A.L. Tyler and D.F. Elkins, "A Time-Domain Technique For Measurement of the Dielectric Properties of Oil Shale During Processing.").

Basically, as appreciated in connection with such recent suggested technique, the process of recovering liquid and gaseous fuels from oil shale for optimum results critically depends on ascertaining the manner in which kerogen decomposes under the particular pyrolysis conditions so as to form bitumens, and in turn oil and gas constituents. In this regard, the thermal behavior of materials which undergo thermal decomposition or phase transformation, such as kerogen in oil shale, must be characterized in some way to achieve this purpose. It is conveniently done by thermo analytical technique, e.g. differential thermal analysis or thermogravimetry. Indeed, measurement of the electrical properties of such materials is currently deemed more or less essential to any thermophysical characterization, considering the concordantly extreme sensitivity of such electrical properties to those physical and/or chemical changes which take place during the thermal decomposition of phase transformation of such materials under the heating conditions.

In the general instance of the known point by point frequency domain measurement technique, a large number of representative measurements over a wide frequency range has usually been considered necessary in order to obtain a complete characterization of a given dielectric material, thereby involving a time consuming procedure which may necessitate repeated and laborious measurement techniques. This, in turn, severely limits the adequacy of the measurements for tracking such fast or abrupt chemical changes, e.g. those changes which take place as oil shale is heated rapidly, inasmuch as an inherent minimum time limit for the heating rate which can be used is governed by the minimum time it takes for the dielectric measurements over the sweep of the frequency range at the given temperature.

According to the aforesaid recent particular technique which has been suggested, the procedure requires considerably less time to perform the measurements, and employs a small shunt capacitor terminating a coaxial line section as the sample holder, whose geometrical dimensions were selected to provide a 50 (i.e. 50 omega or 50 ohm) coaxial line terminated by a capacitance in the optimum range, because of the direct relation of the optimum capacitance value to the frequency band of interest and the dielectric constant of the material being tested. This particular recent technique provides broadband information on the frequency characteristics of the oil shale tested, from a single time-domain measurement, and is said to constitute a rapid and sensitive method of tracing reactions as they proceed under varying conditions.

The experimental (laboratory) set up of such measurements utilizes a time-domain reflectometer and oscilloscope connected to the coaxial transmission line section terminated by the small lumped capacitor, with the oil shale sample placed in the gap of the capacitor sample holder and the measurement procedure following closely that generally utilized in the past. A reference signal from a short circuit placed at the sample holder location and the reflected signal at the sample interface are recorded, digitized, and their Fourier transform is calculated. This procedure determines the frequency dependence of the reflection coefficient, which can then be used to calculate the real and imaginary parts of the relative permittivity in the usual way.

The dielectric constant of the oil shale sample of estimated richness of 120 liters/ton or 30 gpt (i.e. 120/4 at 4 liters/gal) was measured using the sample holder and the permittivity results obtained from such time-domain measurements were stated to agree clearly with the point by point frequency domain results obtained by former known methods, yet provided dielectric constant data for such oil shale in the frequency range which included the band between 10–250 MHz, where no data were previously known. The results covered the dielectric constant of such 30 gpt oil shale as a function of the frequency over the broad band from 0.01 to 2.0 GHz (10 to 2,000 MHz), apparently all at a temperature of 25° C., rather than at pyrolysis temperature.

Figure 3:
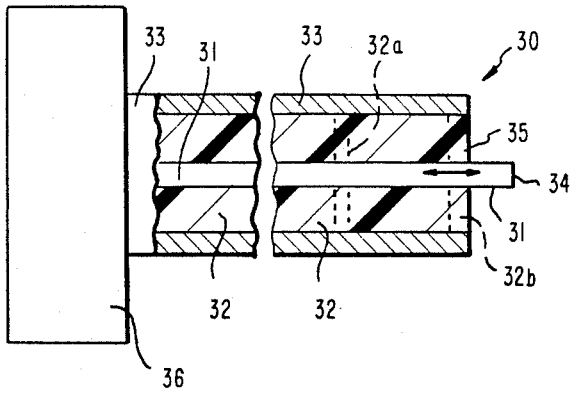
FIG. 3 is a schematic view of an in situ probe system which includes a probe end which may be embedded in the deposit of petroleum impregnated porous media for sensing and indicating the dielectric constant of the carbonaceous constituents undergoing pyrolysis as a function of the microwave radiation being applied to the porous media, and an associated embedded thermal analysis device for recording the temperature at the particular probe site.

In contrast to the foregoing known time domain technique and recent particular technique using a small shunt capacitor terminating a coaxial line section as sample holder, according to a further aspect of the present invention, as shown in FIG. 3, an in situ probe system 30 is provided for on line measurements of the electrical properties of oil shale and other in situ sources of synthetic fuels such a s oil and tar sands, heavy oil reservoir deposits, residual heavy oil polls, and the like type petroleum impregnated porous media or petroleum deposits, using the time domain technique for provided an optimum ongoing RF control for maximizing the extraction of the carbonaceous values sought at minimum expenditure of microwave energy.

The probe system 30 is provided to track at high speed the chemical changes which occur during transformation of the kerogen in oil shale or of the analogous organic matter in the other types of deposits which may be treated according to the present invention, for optimizing the selective RF radiation level of power and frequency for heating the organic constituents and focusing the energy in the oil shale volume or that of the other porous media involved.

The probe system 30, basically consists of an apparatus or assembly which includes an open ended coaxial transmission line with an extended center conductor, such that the extended portion of the center conductor may be embedded in the deposit and its exposed length adjusted for concordant optimum measurement results over the desired frequency band.

As shown in FIG. 3, the probe system or apparatus 30. includes a center conductor or conductive probe 31 as core, insulated electrically, e.g. by the insulating material 32, from its counterpart coaxial peripheral conductor or conductive jacket 33, and having a protruding probe end portion 34 extending beyond the end face 35 of the probe system 30 a selective distance for providing a measuring arrangement for measuring directly in situ the dielectric constant of the oil shale or other porous media in an ongoing manner.

The probe assembly 30 may be selectively positioned in the deposit with the probe end portion 34 embedded in the deposit and the opposite end of the coaxial transmission line may be led via the borehole 7 to the support surface 2 for connection to the usual indicating means such as the recording and information processing equipment 36 in conventional manner.

Alternatively, a separate borehole may be drilled into the formation outwardly of that containing the microwave unit 11 for positioning the probe system 30 more remote from the microwave source. In fact, a number of such separate boreholes may be provided each at a separate radius progressively farther away from the borehole 7 as center, each containing its own such probe system 30 optionally along with such a probe system 30 in the borehole 7.

In each case, the probe system 30 may be positioned in situ in the particular deposit at the desired location by conventional mining or oil drilling technique.

The probe 31 is, of course, slidably arranged within the insulating material 32 to permit relative axial movement thereof for adjustment of the exposed length of the probe end portion 34 from the opposite end of the coaxial transmission line at the ground surface 2.

In this way, the probe system 30 will provide an on line measurement of the complex permittivity of the deposit and the condition of the oil and gas constituents being generated under the microwave pyrolysis, and a feed back system via the remainder of the arrangement leading to the recording and information processing equipment 36 at the ground surface 2, thereby enabling the permittivity probe system 30 to be used to sense and thus control and adjust the RF heating conditions, i.e. by adjustment of the RF power and/or frequency, in accordance with the dielectric constant changes as sensed in situ by the probe end portion 34.

As will be appreciated, the RF frequency adjustment will be made as a function of the relaxation frequency as determined by the permittivity measurements of the probe system 30 and through the feedback system to the equipment 36 on the ground surface 2 as driven by the permittivity probe 31, whereby to control and adjust the RF power and/or frequency for maintaining optimum heating conditions throughout the oil shale volume or other porous media deposit and during the entire heating period.

Thus, using the time domain technique, the in situ probe system 30 is operated according to the present invention to measure the dielectric properties of the particular porous media in the deposit being worked, over a broad frequency band, e.g. 0.01 to 2.0 GHz or 10 to 2,000 M Hz, or more, under the pyrolysis conditions and throughout the volume of the deposit and during the entire microwave heating period.

In particular, the length of the exposed probe end portion 34 beyond the open face 35 of the coaxial transmission line as constituted by the probe system 30 will be longer for measurements at lower attenuated feedback frequencies and shorter, or even possibly completely zero, i.e. with the probe end portion 34 flush with the end face 35, for measurements at higher attenuated feedback frequencies. For instance, the outside diameter of the coaxial transmission line or probe system 30 may be 0.081 inch and the exposed length of the probe end portion 34 may be from 0 (flush) to 0.3 inch.

Thus, the in situ permittivity probe system 30 according to the present invention provides measurement advantages similar to those of the lumped capacitor sample holder earlier described, in that it also provides a link between low and high frequency measurement techniques.

Similar to the adjustment of the capacitance of the shunt capacitor of the transmission line of such sample holder, the in situ probe according to the present invention provides for maximum accuracy in the desired frequency range, but unlike the sample holder, provides for such accuracy not at 25° C., but at the actual pyrolysis temperature, and not at the ground surface, but remotely in situ in the deposit, and merely through selective change in the exposed length of the center conductor or probe end portion 34 extending beyond the end face 35 of the ground plane conductor as constituted by the coaxial transmission line, i.e. as adjusted remotely at the ground surface either manually or by automatic means (not shown) in conventional manner, e.g. in the manner of a Bowden cable.

In essence, the coaxial transmission line or probe system 30 operates analogously to an adjustable receiving antenna or secondary coil of a transformer in picking up as corresponding induced voltages the concordant signals represented by the high frequency microwaves as modified by absorption by the organic matter of the deposit and thus providing an attenuated feedback frequency dependent indication of the ongoing level of the changing dielectric constant of the organic matter at any given point in the pyrolysis heating, and in turn of the degree of transformation and the nature of the transformed constituents present, such as to permit adjustment of the RF frequency in concordance with such changes.

Hence, by adjustment of the exposed length of the center conductor or probe 31 as constituted by the length of the probe end portion 34 extending beyond the end face 35, which by analogy performs the function of a receiving antenna, such antenna may be precisely tuned to the same frequency as that of the radiated microwaves as modified in frequency, i.e. relative to the microwave source originating frequency as reference frequency by the then degree of absorption by the organic matter, thereby providing an ongoing measure of the dielectric constant of such organic matter and changes therein and in turn, a corresponding indication of the ongoing changes in chemical reactions occurring during the pyrolysis.

In regard to an inherent modification of the probe apparatus 30, the insulating material 32, such as a high temperature resistant thermosetting plastic in which the probe 31 is axially slidably maintained, may be alternatively omitted, thereby leaving an electrically insulating void annular space or vacuum space from which air has been excluded so as to avoid a source of contaminating air for the microwave pyrolysis of the organic matter in the porous media.

In this case, as shown in phantom in FIG. 3, a series of insulating fixed radial spacers 32*a* may be located along the course of the interior of the coaxial transmission line to keep the probe 31 and jacket 33 electrically apart, plus gas sealing insulating end radial spacers 32*b* plugging the opposed ends of the transmission line or at least the in situ probe end at the electrically open end face 35, in conventional manner.

Optionally, such void annular space may be filled by captively contained inert gas in place of a vacuum condition.

In any case, the probe end plugging spacers 32*b*, as the case may be, will be sized for sliding sealing fit with the probe 31 passing therethrough to prevent gas or liquid leakage thereat, so as to inhibit fluid exchange between the porous media zone surrounding the embedded probe end 34 and the interior of the coaxial transmission line when not physically occupied by the insulating material 32.

Naturally, the remote end of the coaxial transmission line need not be positioned at the ground surface 2, but as the artisan will appreciate, may instead be positioned within or in the vicinity of the borehole 7 or the microwave unit 11, or in a separate borehole, as desired, and electrically connected by suitable wire leads to the equipment 36, and via a Bowden cable arrangement or the like, also mechanically connected to such equipment 36 for axially adjusting the probe 31 relative to the jacket 33.

Advantageously, as shown in phantom in FIG. 3, an associated conventional in situ thermal analysis device or means 37, or the like type temperature sensing and recording means, is optionally yet preferably also provided in the probe system 30.

The thermal analysis means 37 has an exposed sensing portion 38 adjacent the in situ probe end at which the probe end portion 34 of the axially shiftable central conductive core 31 is located, for corresponding embedding in the porous media whereby to sense and record the prevailing temperature at the particular in situ probe site, by way of differential thermal analysis technique and attendant calculations as earlier described.

For this purpose, the indicating means of the conventional recording and information processing equipment 36 or the like is also arranged for indicating the temperature sensed by the sensing portion 38 at the in situ probe site in conventional manner, the thermal analysis means 37 being operatively connected with the equipment 36 or the like in the same way as the remainder to the probe system 30 is so connected as earlier described, whereby to achieve recordable form feedback information as to both permittivity and temperature.

Hence, the overall probe system 30 may be operated not only for sensing in situ changes in the dielectric constant via the positioning of the probe end portion 34, but also for sensing in situ the prevailing temperature via the sensing portion 38.

In this way, the microwave pyrolysis operation may be effectively carried out with ongoing adjustment of the microwave radiation in dependence upon the sensed changes in dielectric constant in conjunction with sensed changes in the prevailing pyrolysis temperature, i.e. as sensed, recorded and/or indicated via the indicating means such as the remotely located equipment 36.

Of course, it will be appreciated that a separate temperature sensing and recording means (not shown), may instead be used for sensing and indicating the prevailing pyrolysis temperature at the pyrolysis site.

However, by incorporating such means in the probe system 30, as preferred in accordance with the present invention, a more convenient and efficient overall combination, as a simplified composite unitary arrangement is provided, which assures that the temperature sensed is that at the very same localized point at which the probe end portion 34 is situated in the underground porous media, and which is positionable as a common embeddable assembly all at one and the same time.

In connection with the use and location of the instant in situ permittivity probe system 30, according to the present invention, it has been determined that petroleum impregnated media, such as oil shale, etc., tend to be rather constant in their content for significant distances.

In the case of oil shale in particular, the consistency of its content or makeup, as between its composition of carbonaceous constituents and mineral constituents, within a specific bed or formation, can literally run for miles, or certainly at least thousands of feet horizontally. As earlier noted, the various beds of hydrocarbon impregnated media, such as oil shale, generally are situated in substantially horizontal planes whose deviation from true horizontal is minimal, e.g. less than 1%.

Therefore, it is normally not necessary to sample each bed in the vicinity of each borehole 7 being worked when recovering the carbonaceous values by the microwave pyrolysis process according to the present invention, such as by the use of sample bores at progressive radial distances from each adjacent borehole in a given formation area to obtain preliminarily core samples at each vertically successive bed adjacent each such borehole for initially determining in conventional manner the concordant composition of the carbonaceous constituents and mineral constituents thereof, and especially potential gpt yield information, in conjunction with the subsequent use of the probe system 30 to indicate RF values, times, etc. in terms of ongoing measurement of the dielectric constant and pyrolysis temperature at each corresponding underground site of the in situ pyrolysis process and at such progressive radial distances from the particular borehole 7 as the pyrolysis progresses, e.g. in the manner shown in FIGS. 2*a* and 2*b*.

Instead, as to a given formation area, once the carbonaceous and mineral constituent content or makeup of each pertinent bed has been determined by core sample analysis in conjunction with the use of the probe system 30 in corresponding probe bores at respresentative progressively increasing radial distance from the borehole 7 being worked to obtain information as to RF values, times, etc. as noted above, consequent an initial microwave pyrolysis, it is reasonably safe to assume that the same dielectric constant and pyrolysis temperature information obtained by the indicating means such as the equipment 36 at the borehole 7 area bed site can be used to carry out the microwave pyrolysis operation at adjacent borehole areas being worked where substantially the same gallons per ton carbonaceous values and minerology content exist, due to the consistency of the bed formation content for each appropriate bed or stratum over pronounced horizontal distances covering large areas as pointed out above.

Thus, sample probe bores can be set at a predetermined radial distance apart relative to a given borehole 7 being worked, and in conjunction with core sample analysis therefrom in turn can be provided with corresponding probe systems 30 embedded into the impregnated media adjacent each such probe bore at the level of the given bed being worked, for obtaining the desired information during the microwave pyrolysis operation carried out at that borehole 7, such that this sampling process need be used for instance only once per 100 adjacent boreholes 7 in a given vicinity.

In this regard, as shown in FIG. 1, where core sample analysis of the rich oil shale beds 5 and lean oil shale beds 6 shows for instance that all of the beds 5 have substantially the same composition and gpt yield characteristics, and that all of the beds 6 have the same composition and gpt yield characteristics, yet different from those of the beds 5, then the sampling process need by used only for a bed 5, i.e. the lowermost bed 5, and separately only once for a bed 6, i.e., the lowermost bed 6, at a given borehole 7.

This sampling process need only be modified for more frequent use i.e., for a lesser number of adjacent boreholes 7 in a given vicinity or for a greater number of vertically disposed beds at a given borehole 7, when production differences are noted that indicate a change along or within the corresponding beds of a given formation as to gallons per ton carbonaceous values or mineral content thereat.

Figure 4:
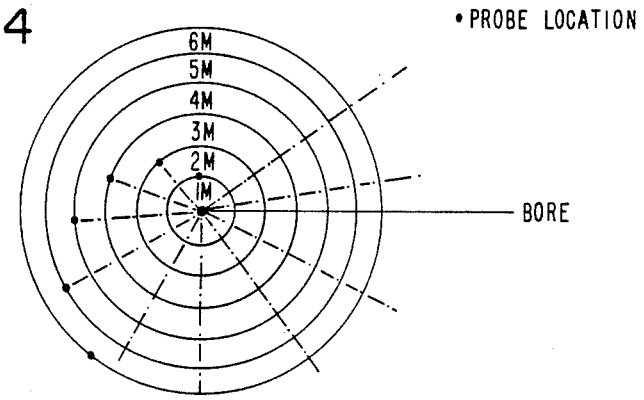
FIGS. 4 and 5 are schematic top and perspective views respectively of a spiral arrangement of sample probe bores containing probes or probe systems of the type shown in Fig. 3, for obtaining information during microwave pyrolysis operations carried out in a deposit adjacent a borehole having an installation of the type shown in FIG. 1.
Figure 5:
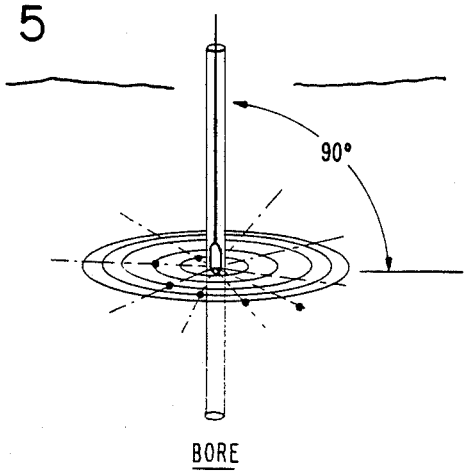

A typical example of carrying out such sampling process using an array of in situ permittivity probe systems 30 according to the present invention is shown in FIGS. 4 and 5.

As seen from above in FIG. 4, relative to the main borehole 7 in the formation at the level of a given bed of the petroleum impregnated media, e.g. oil shale, being worked such as the lowermost bed (FIG. 1), a series of sample probe bores, only probe bores b-1 to b-7 of which are shown, substantially vertically extending from the ground surface down to the level of the bed being worked and also substantially parallel to the associated main borehole 7, is provided.

Preferably, the probe bores are disposed in the form of a more or less generally outwardly increasing radius spiral arrangement at least partially around the main borehole 7 as center and spaced therefrom and from one another at intermittent distances to the full extent of the RF penetration, i.e. along the entirety of the recapture distance or recapture radius for that borehole 7.

Appropriate analysis of core samples from all of the beds is preliminarily undertaken (FIG. 1).

Each probe bore is provided with a corresponding probe system 30, here designated as probes, only concordant probes p-1 to p-7 of which are shown, embedded in situ in the adjacent petroleum impregnated media at the particular probe bore at the corresponding level of the bed or stratum being worked. Each such probe or probe system 30 is of course connected to an appropriate indicating means such as the equipment 36 as earlier described such as at the ground surface 2 (FIG. 1).

The actual spacing of the probes is determined by the carbonaceous values, e.g. gpt content, and associated minerology of the deposit involved at the given bed or stratum being worked, as determined by such preliminary core sample analysis.

For instance, in the case of 25 gpt oil shale the radial distance apart of the probe bores, and thus of the probes, is preferably one meter, although the actual distance apart or radial distance intervals at which the probe bores and associated probes are located may be varied, depending on the degree of detail or preciseness of the information desired to be provided via the indicating means such as the equipment 35, as well as upon the nature and consistency of the deposit along the extent of the recapture distance or recapture radius involved for the given bed level site.

It will be seen from FIG. 4 that the probe bores and thus the probes are at generally equal radial increments apart, i.e. at successive progressively increasing circumferential or annular zones or rings relative to the main borehole 7 as center, with each such annular zone or ring having the same radial interval or internal radius span as the next. In this way, uniform and precise information can be obtained via the probes throughout the recapture distance or recapture radius of the borehole 7 being worked at the given bed level site.

On the other hand, it will be seen that the actual linear distance between adjacent probe bores and thus between adjacent probes progressively increases along the course of the spiral arrangement so that a representative arc portion about the borehole 7 at the given bed level site is provided with the probes.

Although this arc is shown over an angular sweep of about 180 degrees from probe p-1 to probe p-7, it will be appreciated that such arc may be conveniently selected to provide any desired sweep so long as it is able to provide representative permittivity information for the entirety o the contemplated bed area within the pertinent recapture distance or recapture radius involved.

Hence, where more than seven probe bores and associated probes are involved, e.g. at 1 meter intervals of progressively increasing radius apart, the linear distance between adjacent probe bores can be kept constant or of smaller increments of progressive increase apart to maintain the angular sweep of the spiral arrangement at about 180 degrees along the course of the recapture radius, or the angular sweep may extend therebeyond, e.g. over 270 degrees or even 360 degrees, or may repeat itself in multiple spiral revolutions by continuing progressively to 540 or 720 degrees or more, as may be appropriate under the circumstances, especially in the case of more pronounced recapture radius deposits, e.g. having a recapture radius of 38 feet or more, all of course in dependence upon the conjoint equal or uniform or nonuniform progressively changing radial increments apart of the probe bores (cf. the nonuniform radial increments at which the microwave power is incrementally increased according to the present invention as shown in FIGS. 2*a* and 2*b*).

In any case, the spiral arrangement of the probes in the probe bores is such that the microwave radiation MR as schematically shown in FIG. 4 distributed from the microwave unit 11 (FIG. 1), e.g. in a full 360 degree arc pattern, will be effectively sensed by the probes p-1 to p-7, etc. as the case may be for the desired purposes at the given bed level site.

Because of the generally true horizontal orientation of the beds of petroleum impregnated media in the formation, it will be seen from FIG. 5 that the spiral array of probes p-1 to p-7 etc. is located in a plane P generally parallel to the horizon or at right angles to the vertically disposed main borehole 7 in the formation, and disposed at the corresponding underground level of the microwave unit 11 suspended via the pipe 9 in the borehole 7, i.e. at the vertical depth at which the bed containing the deposit being worked is located.

Although such probes are generally arranged in a common horizontal plane at a 90 degree angle relative to the main borehole 7, as shown in FIG. 5, as where the bed being worked extends generally in true horizontal orientation as earlier described, naturally where the particular bed encountered lies at an inclined angle to the true horizontal, the probe bores will be adjusted in depth so that the probes may be lowered therein sufficiently to be positioned adjacent the corresponding bed level in each at which the deposit being worked is located, whereupon the common plane P containing the spiral array of probes will assume an inclined angle so as to register or conform intersectingly with the inclined angle bed deposit.

In the case, the microwave unit 11 will be angularly positioned as well for distributing its microwave radiation along and through the inclined angle bed deposit.

In all cases, the spiral array of probes is arranged such that readings are taken at the same relative planar level or elevation as the R source, i.e. the microwave unit 11, and thus at the average vertical center of the RF energy radiated area.

For instance, for an oil shale bed of three feet in vertical height, the microwave unit 11 is desirable positioned in the borehole 7 such that the radiation is distributed in vertical alignment with the 1½ foot midpoint height of the bed, and the probes p-1 to p-7 etc. are positioned in their respective probe bores b-1 to b-7 etc. in a common plane P passing through the bed and in corresponding collective vertical alignment with such 1½ foot midpoint height of the bed.

The sample probe bores, like the main borehole 7, are provided in conventional manner, and the probes are embedded into the adjacent deposit in conventional manner, e.g. via a pipe or line support arrangement similar to pipe 9 for borehole 7, preferable equipped with an inflatable sealing collar analogous to collar 10 and for the same purposes, or alternatively using ground surface saeling of the probe bores during the pyrolysis operation.

Thus, in the event the sampling process is used successively for each bed in the formation (FIG. 1), the probes are repositioned upwardly in their corresponding bores at the level of the next above bed deposit to be worked, just as in the case of the microwave unit 11 in the main borehole 7, and after the last or highest bed deposit in the formation has been worked, the probes will be pulled permanently from the bores for repeated use at a different area where permittivity information is to be obtained, and the bores will be sealed permanently at the ground surface just as in the case of the main borehole 7.

Desirably, the extent of the probe bore below the level of the particular bed being worked at which the probe is located, will be plugged permanently by a cement plug analogous to cement plug 23 in the case of the main borehole 7 and for the same reasons, and such cement plugs will be added along the upward course of the probe bores as the pyrolysis operation upwardly progresses from one bed deposited to the next (cf. FIG. 1).

On the other hand, where the core sample analysis shows that for a given bore hole 7 location the formation contains for instance 20 oil shale beds, e.g. including 4 very rich beds of 42 gpt, 9 average rich beds of 30 gpt and 7 lean beds of 20 gpt, the sampling process is used only at the corresponding lowermost bed of each of three different types of beds, and in the case of the intervening bed sites, the probe bores are plugged progressively upwardly as aforesaid so that the pyrolysis operation at the intervening bed sites is carried out with the microwave unit 11 alone being used in the main bore hole 7.

In this instance, the recorded information obtained pursuant to the sampling process, using the probes at each of three different type bed sites, is immediately employed for carrying out the pyrolysis operation with the microwave unit 11 alone in the main borehole 7 for each of the subsequent above beds of the same type.

In all instances, the second changes in dielectric constant, and favorably the associated sensed changes in prevailing temperature, at the in situ bed level site being worked and the timing of such sensed changes incrementally along the course of the progressing pyrolysis operation to the outer limits of the recapture radius involved, and consequent changes and their timing incrementally along such course of the applied RF energy; e.g. initially at incrementally increasing and thereafter substantially constant continuous correspondingly increased radiation power and/or initially in intermittent cycles of on and off duration at substantially constant or preferably incrementally increasing radiation power, and especially initially both at incrementally increasing radiation power and in intermittent cycles of on and off duration in a first phase, and thereafter at substantially constant correspondingly increased power continuously in a second phase (e.g. per FIGS. 2*a* and 2*b*); i.e. in dependence upon such sensed changes and their timing, will provide recorded parameter information for repeating the pyrolysis operation at a separate borehole site of such porous media of substantially the same type without the need for such probes thereat.

On the basis of test operations for carrying out microwave heating of petroleum impregnated media such as oil shale to achieve selective microwave pyrolysis of the carbonaceous values, it has been determined that there is really no optimum frequency that is best suited for hydrocarbon heating in situ in the impregnated media in accordance with the present invention.

As earlier noted in this regard, the energy absorption by the organic matter in the impregnated media is fairly constant over a wide range of microwave frequencies as indicated by the relative stability of the dielectric constant over such wide range of frequencies.

The important factor is generally only that the microwave frequency selected be within the radar range, i.e. significantly higher than sound wave frequencies or audio frequencies which range from about 15 to 20,000 cycles per second (cps) or about 0.015 to 20 kilocycles per second (kps), and thus the radar range contemplated radio frequencies or microwave frequencies will be generally higher than 20 kps or 0.2 M Hz (million cycles or megacycles per second), such as at least about 0.3 M Hz and up to over 30.0 M Hz or up to over 30 G Hz (billion cycles or giga cycles per second), e.g. typically from about 10 to 5,000 M Hz, especially about 750 to 4000 M Hz.

It will be realized, of course, that as the microwave frequency selected increases, the power required to generate such frequency decreases, and the analogous antenna length requirements for the exposed portion of the probe end portion 34 relative to the end face 35 of the particular probe system 30, for sensing in effect changes in attenuated feedback frequency, is concomitantly decreased or shortened. Hence, other things being equal, the use of higher RF microwaves is preferred since this results in a conservation of the electric power which must be expended (cf. FIGS. 2*a* and 2*b*).

For instance, microwave pyrolysis experiments of actual resource oil shale samples were conducted equally well using a comparatively low microwave frequency of 915 M Hz and separately using a comparatively high microwave frequency of 2450 M Hz. The only significant difference was that the lower frequency microwaves seemed to carry or impart more heat, while the higher frequency microwaves seemed to possess or cause a greater degree of penetration, into the sample.

Perhaps more significant to the microwave pyrolysis process according to the present invention is the practical consideration of the available RF equipment, such as the microwave unit 11, and its particular physical characteristics.

For example, where a microwave frequency of 915 M Hz was used in an associated wave guide for distributing the RF radiation into the sample for pyrolysis of the carbonaceous content of the impregnated media, the wave guide needed to be considerably larger than that in the case of such pyrolysis using a higher microwave frequency such as 2450 M Hz.

Depending on the nature and disposition, therefore, of the particular formation deposit of petroleum impregnated media, the dimensions of the microwave distributing equipment may have to be matched or modified for accommodating the same. Thus, should smaller equipment dimensions for a given microwave unit 11 be required in order to best serve the particular characteristics of a given formation deposit, e.g. involving a wave guide arrangement of small physical dimensions for distributing the microwave radiation, then higher microwave frequencies will in turn be used concordantly therewith, and vice versa.

It will be realized in this regard, that although generally any frequency within the radar range may be used for providing the microwave energy for in situ pyrolysis of the petroleum impregnated media according to the present invention, the particular frequency selected will normally not be changed but instead will remain static or constant throughout the usual pyrolysis production operation.

In this regard, the changes in attenuated feedback frequency sensed by the probe systems 30, where used, as the pyrolysis progresses, may thus be measured against the static or constant microwave source originating frequency as an unchanging reference frequency.

On the other hand, at such static or constant frequency, the radiation power will incrementally increase during the in situ pyrolysis operation, and/or the energy supplied time intervals of on-off power will vary selectively, i.e. as individual or conjoint functions of the total in situ petroleum impregnated media under treatment for optimum results (cf. FIGS. 2*a* and 2*b*).

As earlier noted, the applying of RF energy by continuous input of steady or constant level power, e.g. at static or constant frequency, is to be avoided since this has been determined to result in a decrease in the production rate, rather than to provide a nearly constant rate of production throughout, due to mineral, or even perhaps residual carbon, absorption of microwave energy which concomitantly increases as the length of the mineral or rock path increases in a direction away from the borehole 7.

Accordingly, a desirable primary feature of the present invention is the carrying out of the in situ pyrolysis with the use initially of incrementally increasing power, e.g. at constant frequency, and/or at associated varying time intervals of on-off power as the pyrolysis progresses along the extent of the deposit towards the outer zone represented by the pertinent recapture radius.

Of course, depending upon the characteristics of the particular formation deposit to be worked, a modified form of the microwave distributing equipment such as microwave unit 11, may have to be provided, such as one having a wave guide system of smaller dimensions, e.g. for supplying microwave radiation at a higher frequency range or level such as that of a 3500 M Hz frequency range or higher.

In any case, for convenience, once a given microwave unit 11 is provided of given characteristics and dimensions, including its wave guide dimensions which will normally determine its microwave operating frequency, the equipment will be fashioned to operate generally only at the specific frequency chosen.

In line with such considerations, Table 1 above provides a typical time schedule of applied incrementally increasing RF power, obtainable for example at a constant frequency of 915 M Hz and also alternatively at a constant frequency of 2450 M Hz. The temperatures reached along the successive ring portions of the deposit are illustrated in FIG. 2*b*, in this regard. In essence, the deposit is progressively subjected to the pyrolysis temperatures indicated, since inherently such temperatures must be reached for the conditions to be sufficient to induce organic decomposition, e.g. at an average of about 450° C., as specified in Table 3 above.

These various parameters are ascertained by a spiral arrangement of probe systems 30 as shown in FIGS. 4 and 5.

It has been determined that the petroleum production curve rises sharply as the radius of penetration increases and as the wattage applied is increased accordingly as indicated in FIG. 2*b*. The production rate (PR) may be designated as the square of the radius (r) from the borehole 7 to that distant circumferential point that is effectively penetrated by the applied wattage at maximum power, e.g. 100 KW as shown in FIG. 2*b*. The makeup of the recovered products for a 30 gpt yield, from 1 cubic foot of oil shale, on a 23.3 pound organic matter (and water) weight basis, and on a 485 $ft^3$ organic matter (and water vapor) basis, is as earlier listed.

Understandably, product production is subject to several factors such as the gpt yield potential of the deposit, the height or vertical thickness of the bed being radiated by the microwave energy, etc. Even on the conservative assumption that, for a given microwave unit 11 of conventional design, a three foot vertical thickness of a given bed deposit is the maximum range that can be successfully worked by the microwave unit 11, i.e. without having to reposition the unit 11 at a higher level in alignment with the contiguous next higher level of vertical thickness of the same bed deposit, such as in the case of an oil shale bed deposit of for instance 6 or 9 feet in overall vertical thickness, then based on likewise conservative assumption of a 50% recovery rate of 30 gpt oil shale at a yield of only 0.049 bbl per cubic foot in the three foot bed thickness range involved, a production rate of 0.147 bbl per square foot of area of the three feet thick deposit being worked will be obtained (i.e. $0.049 \times 3$).

At a corresponding area of microwave penetration of 4,000 $ft^2$, i.e. a total circular area corresponding to a recapture radius of just under 36 feet (cf. Table 1 above), about 588 bbl of oil or petroleum product will be obtained (i.e. $0.147 \times 4000$).

For a typical Wyoming formation of 20 oil shale beds (cf. FIG. 1), 11,760 bbl of oil or petroleum product per borehole 7 will be accordingly obtained (i.e. $20 \times 588$).

Advantageously, once a microwave pyrolysis operation has been conducted with an arrangement of probes as shown in FIGS. 4 and 5, to provide the desired information along with that for instance resulting of actual resource samples obtained from representative formation bed deposits, whereby to optimize the conditions of microwave radiation for each given type deposit to be worked, a determination can be conveniently made as regards the power requirements for each given type bed deposit, or cumulatively for all successive bed deposits at a given borehole 7 (cf. FIG. 1).

This representative programming information can thus be used concordantly at different boreholes 7 in the same type formation.

In this way, the production operation can be undertaken such that a large number of separate boreholes 7 may be worked at the same time. Clearly, it is practical and especially very economical to power several RF generators or microwave units 11 and associated borehole 7 operations from one DC generator such as electric generator 22 (FIG. 1).

This is especially so in the case of the preferred predominant use at least initially of intermittent microwave power intervals of on-off RF energy in a given borehole 7 as illustrated in FIGS. 2*a* and 2*b*.

More specifically, due to the very nature of such on-off usage, there is excess incremental DC power available form a given DC generator for the powering of additional RF generators or microwave units 11 during the intermittent off intervals. If this excess available DC power is not used, it is in effect wasted, as DC generators must run constantly as dynamic generators, and cannot be stopped and started synchronously with the on-off power demand of the RF generator or microwave unit 11, e.g. at less than 10 second intervals of on and/or off duration cycles as shown in FIG. 2*b*.

Advantageously, therefore, the dynamically generated DC electrical energy is selectively alternately supplied concordantly in successive intermittent interval alternate or out of phase cycles of on and off duration to the corresponding plurality of microwave units 11. This is done such that, for instance of ten given microwave units 11 in ten corresponding boreholes 7 being worked simultaneously, the even numbered (e.g. second, fourth, sixth, eighth, and tenth) units 11 are only energized during the alternate off duration cycles of the remainder or odd numbered (e.g. first, third, fifth, seventh and ninth) units 11, and in turn the remainder or odd numbered units 11 are only energized during the concordant alternate off duration cycles of the even numbered units 11.

The counterpart out of phase on-off intervals need not be of equal duration (cf. FIG. 2b) so long as the overall available DC energy delivered is sufficient to complement or supplement that otherwise wasted intermittent off cycle energy of the even units 11 used as on cycle energy for the odd units 11, and vice versa, as the artisan will appreciate.

This factor makes possible the efficient more or less complete use of the generated DC power by distributing the same operatively so as to energize several microwave units 11 at separate respective boreholes 7 being worked at the same time and conserves the available energy for power generation, e.g. the noncondensible gas portion of the production product recovered via the pipe 9 at a given borehole 7 installation.

Further advantages are gained by connecting together in conventional manner several DC generators 22 at different borehole 7 installations being simultaneously worked, as by electrically connecting the generators within a common grid system that is arranged for compensatingly powering the microwave units 11 at many borehole 7 installations at once. In turn, several such grid systems may be interconnected for large field production endeavors.

Selective use of the DC power available from such a grid system may be effectively controlled by computer in conventional manner. This is effected, for instance, in conjunction with information indicated by the equipment 36 obtained from the in situ permittivity probe system 30 FIG. 3), and/or from a spiral array arrangement of such probe systems (FIGS. 4 and 5) where used, and also with information obtained from core sample analysis and from surface monitoring of the collected resource, i.e. production product, such that the pertinent information is fed into the computer program in conventional manner and the computer in turn shunts or distributes the DC power to demand points within the operating field in the contemplated way.

The economic advantages of such a grid system are self evident. Not only is the energy resource, e.g. recovered noncondensible gas, that is applied for power generation effectively conserved and efficiently used, but also the capital investment for large scale field development is lowered, i.e. the number of DC generators such as fuel cells, turbines, etc. needed is reduced.

In all appropriate instances, the RF energy is applied at each borehole 7 being worked to distribute the microwave energy for the desired purposes, such as at least initially at incrementally increasing radiation power or at least initially in intermittent cycles of on and off duration at substantially constant or preferably incrementally increasing radiation power; e.g. initially at incrementally increasing power in a first phase and thereafter at substantially constant continuous corresponding increased radiation power in a second phase, or initially in intermittent cycles of on and off duration at substantially constant or preferably incrementally increasing radiation power in a first phase and thereafter at substantially constant corresponding increased power continuously in a second phase, or especially initially both at incrementally increasing radiation power and in intermittent cycles of on and off duration in a first phase and thereafter at substantially constant correspondingly increased power continuously in a second phase.

Such intermittent cycles of on and off duration are generally of a duration of less than 10 seconds, as aforesaid, e.g. at least about 1 second and at most about 3 to 5 seconds in intermittent duration cycles.

On the other hand, where such a grid system is used for simultaneously energizing a plurality of microwave units 11 at separate borehole sites, and the second phase is effected at constant correspondingly increased power continuously, a further portion of the noncondensible gas recovered is desirably used to produce the increased supply of electrical energy needed to energize simultaneously and continuously all of the microwave units 11 at such constant increased power.

Thus, by way of the present invention, an advantageous method is provided which uses the selective application of RF energy for heating the carbonaceous values, e.g. hydrocarbons, in situ, in various underground formation deposits, such as kerogen in oil shale, bitumen in oil sands and tar sands, and heavy oils of high viscosity found in reservoirs located within rock or sand formations, etc.

The application of RF energy or electromagnetic energy for such heating is equally purposeful regardless of the nature of the petroleum impregnated porous media, i.e. oil shale, oil sands, tar sands, heavy oil reservoirs, etc., because the organic matter preferentially absorbs and is molecularly excited by the controlled microwave radiation, regardless of the in situ source of the organic matter, and will be efficiently expelled under the pyrolysis conditions in relatively pure form, i.e. uncontaminated by air or its resultant combustion products with the attendant organic matter.

Moreover, the microwave heating and pyrolysis may be controlled for desired varying of the applied microwave frequencies, intermittent on and off cycle duration and intensity of low or high power or wattage for producing predictable results when working deposits of oil shale, oil sands, tar sands, heavy oils, etc., and in particular, liquid oil, oil vapors, noncondensible gases, residual carbon coke and water in dependence upon the controlled wattage, frequency and rate of application of the microwave energy to the deposit, and while avoiding adverse local overheating and detrimental structural modification of the mineral content which might otherwise rob the overburden of necessary support.

An especial advantage of the present invention is the provided ability to control the amount of each type product yielded by the microwave pyrolysis under the autogenous pressure.

Thus, by continued radiation of the initially produced oil, e.g. from kerogen, tar, and the like, such liquid will be transformed into condensible oil vapors, and by increased radiation of these transformed oil vapors and any liquid oil, the same will be chemically broken down or catalyzed to noncondensible gases, thus permitting selective increase in the content of gases produced.

In turn, the remaining deposit of carbonaceous values in the bedding which is left as a result of this first step of the process and which constitutes residual carbon coke or solid form fixed carbon, will be subsequently gasified as well upon additional and continued RF radiation in the following second step.

These additionally produced gases, primarily carbon monoxide, will enrich the total of noncondensible gases readily obtainable according to the microwave winning process of the present invention, for use in various purposes, and especially to provide the power needed to generate the microwave energy for the underlying pyrolysis extraction at one or simultaneously a plurality of borehole sites, in addition to supplying large amounts of gases for the gas market, as a complement to the amounts of oil being made available for the oil market.

Hence, versatile control of the microwave application under the autogenous pressure conditions will enable the process to be carried out for selectively varying the proportion of the recovered oil and condensible oil vapors, on the one hand, and of the recovered noncondensible gases, on the other hand.

These advantages distinguish the present invention from conventional methods of production since it avoids the fluid transfer method bulk heating and Btu heat loss through dissipation of in situ heating by hot water or steam from a surface generating source, or even chemically provided heat, as well as the fired method bulk heating and oxygen contamination and combustion products attendant such oxygen contamination of surface retorting in the presence of air or oxygen, and the similar inefficiencies of indirect heating of a retorting vessel closed off from air, after having to win the rock and raise it to the ground surface for such retorting.

Besides being more efficient than such bulk heating methods, in applying the required heating energy by microwaves, the present invention accomplishes the heating in precisely controllable manner whereas inherently there can be little, if any, control over the desired results whether using hot water, steam or chemically provided heat for in situ heating or direct or indirect combustion energy supplied fired heat in a surface retort.

Although, on the other hand, the device of said U.S. Pat. No. 4,193,448 contemplates the use of microwave energy for in situ heating of underground petroleum impregnated porous media, it does not apprise the skilled artisan of the carrying out of a controlled microwave energy pyrolysis of the organic matter in the porous media to achieve not only liquid oil flow, but also the generation of both condensible and noncondensible gasified carbonaceous constituents in controllable proportions, and in turn, the scavenging of the remaining carbon coke by further more intensified microwave pyrolysis for gasifying such residual carbon values, all in the substantial absence of air, let alone the use of the noncondensible gas product recovered, in whole or in part, as fuel for generating the required power for operating the microwave distributing source, and thereby efficiently utilizing this plentiful and comparatively inexpensive gas by-product necessarily produced under the contemplated pyrolysis conditions, yet without diminishing the amount of liquid oil product basically sought as synthetic fuel in offsetting any currently existing or potential future energy crisis.

In this regard, it has been heretofore considered that approximately 85% of the shale oil potentially available from oil shale could be recovered in liquid form without vaporization and condensation, which would suggest that lower heat inputs would be required for this technique than for the vaporization of the generated oil. In the early stages of pyrolysis, it has been found that enough bonds are broken in the hydrocarbon constituents for the kerogen to become a viscous liquid with a small portion of about 9 wt. % being converted to gas products.

By way of the present invention, the pyrolysis under the applied microwave radiation is carried out at selectively high generation of gases, including not volatilization of the liquid oil to condensible vapor form, but also creation of comparatively large proportional amounts of noncondensible gases under autogenous pressure promoted molecular breakup. The gases serve to drive the oil constituents from the pores of the shale or other porous media, and under more intense heating increasing proportions of the liquid oil will vaporize and be gasified to noncondensible form, such that any remaining liquid phase oil will be effectively admixed with and entrained in the flow of the gases under autogenous pressure expelling from the pores of the deposit and traveling to the point of recovery, e.g. the microwave unit 11 in the borehole 7.

In the particular case of oil shale, e.g. that containing more than about 30 gpt, when subjected to heating at 425° C. the porous media beings to yield oil under the autogenous gas pressure. After the liquifiable and gasifiable constituents at the selected pyrolysis temperature, e.g. 425°-500° C., have been created or generated, increased energy recovery can be undertaken simply by continuing the microwave radiation for gasification of the residual solid carbon left in the shale at that point in the pyrolysis process. This solid carbon residue significantly amounts in some cases to about 25 wt. % of the carbon originally present in the kerogen, and is not included in the Fischer assay of pyrolysis products obtained from oil shale at the usual temperature, e.g. 425°-500° C.

Thus, advantageously by way of the present invention, after the initial stage pyrolysis of the kerogen and its removal, gasification of the solid residual carbon may be undertaken by containing the RF radiation at higher pyrolysis temperature, e.g. from about 525° C. to sufficiently below about 600° C. to avoid formation of product water. This subsequent stage of the overall pyrolysis is aided by the fact that at this point the shale or other porous media is quite porous and permeable to gas flow therethrough since the voids which had previously contained kerogen will have been emptied, whereupon the solid carbon or coke gasification will efficiently occur throughout the volume of the thus far processed shale and essentially completely scavenge all extractable carbonaceous constituents remaining at that point.

It will be appreciated that the foregoing specification and accompanying drawings are set forth by way of illustration and not limitation, and that various modifications and changes may be made therein without departing from the spirit and scope of the present invention which is to be limited solely by the scope of the appended claims

What is claimed is:

1. Process for in situ recovery of extractable carbonaceous values from underground petroleum impregnated porous media comprising:

subjecting the underground petroleum impregnated porous media, in situ and in the substantial absence of air, to microwave radiation from a microwave distributing source substantially immediately adjacent the media and distributed at least initially at incrementally increasing radiation power, for heating the impregnated petroleum content preferentially relative to the corresponding porous media and progressively in a direction away from the microwave source and to a selective temperature of at least about 425° C. and sufficiently for liquefying substantially the liquefiable petroleum constituents present which liquify at the corresponding heating temperature and in turn for causing the thereby formed mixture of liquified and gasified constituents to migrate under autogenous pressure through the porous media in a direction toward the microwave source; and recovering the migrating constituents from the vicinity of the microwave source; and wherein the radiation is distributed initially in intermittent interval cycles of on and off duration in a first phase, and thereafter is distributed substantially continuously in a second phase.

2. Process of claim 1 wherein the intervals of on duration progressively increase in the first phase.

3. Process of claim 2 wherein the intervals of off duration progressively decrease in the first phase.

4. Process for in situ recovery of extractable carbonaceous values from underground petroleum impregnated porous media comprising:

subjecting the underground petroleum impregnated porous media, in situ and in the substantial absence of air, to microwave radiation from a microwave distributing source substantially immediately adjacent the media and distributed at least initially at incrementally increasing radiation power, for heating the impregnated petroleum content preferentially relative to the corresponding porous media and progressively in a direction away from the microwave source and to a selective temperature of at least about 425° C. and sufficiently for liquefying substantially the liquefiable petroleum constituents present which liquify at the corresponding heating temperature and in turn for causing the thereby formed mixture of liquified and gasified constituents to migrate under autogenous pressure through the porous media in a direction toward the microwave source; and recovering the migrating constituents from the vicinity of the microwave source; and wherein the radiation is distributed initially at incrementally increasing radiation power in a first phase, and thereafter is distributed at substantially constant corresponding increased power in a second phase.

5. Process of claim 4 wherein the radiation is distributed in intermittent interval cycles of on and off duration in the first phase, and thereafter is distributed substantially continuously in the second phase.

6. Process of claim 5 wherein the intervals of on duration progressively increase in the first phase.

7. Process of claim 6 wherein the intervals of off duration progressively decrease in the first phase.

8. Process for in situ recovery of extractable carbonaceous values from underground petroleum impregnated porous media comprising:

subjecting the underground petroleum impregnated porous media, in situ and in the substantial absence of air, to microwave radiation from a microwave distributing source substantially immediately adjacent the media and distributed at least initially at incrementally increasing radiation power, for heating the impregnated petroleum content preferentially relative to the corresponding porous media and progressively in a direction away from the microwave source and to a selective temperature of at least about 425° C. and sufficiently for liquefying substantially the liquefiable petroleum constituents present which liquify at the corresponding heating temperature and in turn for causing the thereby formed mixture of liquified and gasified constituents to migrate under autogenous pressure through the porous media in a direction toward the microwave source; and recovering the migrating constituents from the vicinity of the microwave source; and wherein the radiation is distributed initially at incrementally increasing radiation power and until the heating of the impregnated petroleum content has progressed to the linear extent of at least about 20 feet in at least one direction away from the microwave source in a first phase, and thereafter is distributed at substantially constant correspondingly increased power in such direction in a second phase.

9. Process of claim 8 wherein the radiation is distributed initially in intermittent interval cycles of on and off duration in the first phase, and thereafter is distributed substantially continuously in the second phase.

10. Process of claim 9 wherein the intervals of on duration progressively increase in the first phase.

11. Process of claim 10 wherein t he intervals of off duration progressively decrease in the first phase.

12. Process of claim 8 wherein the temperature is between about 425°–500° C.

13. Process of claim 12 wherein the temperature is between about 425°–475° C. for thereby forming a mixture of predominantly liquified constituents and a corresponding remaining minor amount of gasified constituents.

14. Process of claim 12 wherein the temperature is between about 476°–500°C. for thereby forming a mixture of predominantly gasified constituents and a corresponding remaining minor amount of liquified constituents.

15. Process for in situ recovery of extractable carbonaceous values from underground petroleum impregnated porous media comprising:

subjecting the underground petroleum impregnated porous media, in situ and in the substantial absence of air, to microwave radiation from a microwave distributing source substantially immediately adjacent the media and distributed at least initially at incrementally increasing radiation power, for heating the impregnated petroleum content preferentially relative to the corresponding porous media and progressively in a direction away from the microwave source and to a selective temperature is between about 425°–500° C. and sufficiently for liquefying substantially the liquefiable petroleum constituents present which liquify at the corresponding heating temperature and in turn for causing the thereby formed mixture of liquified and gasified constituents to migrate under autogenous pressure through the porous media in a direction toward the microwave source; and recovering the migrating constituents from the vicinity of the microwave source; and wherein in a first step, the radiation is distributed until substantially all of the liquefiable and volatilizable constituents present which concordantly liquify and gasify at the corresponding heating temperature have been liquified and gasified and in turn recovered, and thereby leaves a remainder content of residual unliquified and ungasified carbon constituents in the corresponding porous media; and in a second step, substantially without interruption, the porous media is thereafter subjected to continued radiation from the microwave source correspondingly for heating such residual carbon constituents to a selective temperature of at least substantially about 525° C. and below about 600° C. and sufficiently for gasifying substantially such residual carbon constituents and in turn for causing the thereby gasified residual carbon constituents to migrate under autogenous pressure through the porous media in a direction toward the microwave source, and the migrating gasified residual carbon constituents are then recovered from the vicinity of the microwave source.

16. Process of claim 15 wherein the microwave source is located in a well bore at a level adjacent an underground stratum of the porous media, and the migrating constituents are recovered from the vicinity of the microwave source via the well bore.

17. Process of claim 15 wherein the porous media are oil shale media, and the carbonaceous values include kerogen which is correspondingly pyrolyzed by said heating.

18. Process of claim 15 wherein a portion of the recovered constituents is used to produce electrical energy for energizing the microwave distributing source.

19. Process for in situ recovery of extractable carbonaceous values from underground petroleum impregnated porous media, comprising:

in a first step, subjecting as underground stratum of the petroleum impregnated porous media, in situ and in the substantial absence of air, to microwave radiation from a microwave distributing source located in a well bore at a level substantially immediately adjacent such underground stratum, for heating the impregnated petroleum content to a selective temperature sufficiently for liquefying substantially the liquefiable petroleum constituents present which liquify at the corresponding heating temperature and for gasifying substantially the volatilizable petroleum constituents present which gasify at such heating temperature and in turn, for causing the thereby formed mixture of liquified and gasified constituents to migrate under autogenous pressure through the porous media in a direction toward the microwave source; and recovering the migrating constituents from the vicinity of the microwave source via the well bore;

the selective temperature being insufficient for liquefying and gasifying residual carbon constituents in the corresponding porous media and thereby leaving a remainder content of residual unliquified and ungasified carbon constituents therein; and in a second step, substantially without interruption relative to the first step, subjecting the porous media thereafter to a continued radiation from the microwave source correspondingly for heating such remainder content of residual unliquified and ungasified carbon constituents therein to a selective increased temperature sufficiently for gasifying substantially such residual carbon constituents and in turn, for causing the thereby gasified residual carbon constituents to migrate under autogenous pressure through the porous media in a direction toward the microwave source; and recovering the migrating gasified residual carbon constituents from the vicinity of the microwave source via the well bore; and wherein the first step temperature is between about 425°–400° C. and the second step temperature is at least substantially about 525° C. and below about 600° C.

20. Process of claim 19 wherein a portion of the recovered gasified constituents includes noncondensible gas and at least a portion of such noncondensible gas is used to produce electrical energy for energizing the microwave distributing source.

21. Process of claim 20 wherein the first step temperature is between about 476°–500°C. for thereby forming a mixture of predominantly gasified constituents and a corresponding remaining minor amount of liquified constituents.

22. Process of claim 21 wherein the porous media are oil shale media, and the carbonaceous values include kerogen which is correspondingly pyrolyzed by said heating.

23. Process for in situ recovery of extractable carbonaceous values from underground petroleum impregnated porous media, comprising:

substantially simultaneously subjecting each of a plurality of separate individual sites of underground petroleum impregnated porous media, in situ and in the substantial absence of air, to microwave radiation from each of a corresponding plurality of microwave distributing sources substantially immediately adjacent the porous media at each such site respectively and distributed at least initially in successive intermittent interval alternate cycles of on and off duration and sufficiently for heating the impregnated petroleum content for extracting extractable carbonaceous values therefrom, while correspondingly at least initially selectively alternately supplying electrical energy concordantly in successive intermittent interval alternate cycles of on and off duration to the corresponding microwave sources, such that selectively some of the plurality of microwave sources are only energized during the alternate off duration cycles of the remainder of the microwave sources are only energized during the alternate off duration cycles of said some of the microwave sources, for substantially complete utilization of said electrical energy; and recovering the thereby extracted carbonaceous values; and wherein the radiation is distributed initially at incrementally increasing radiation power and in intermittent cycles of on and off duration in a first phase, and thereafter is distributed at substantially constant correspondingly increased power to each of the microwave sources in a second phase under a concordantly increased supply of electrical energy sufficiently to energize substantially simultaneously and continuously all of the microwave sources at such constant increased power.

24. Process of claim 23 wherein at least a further portion of the recovered carbonaceous values is used to produce the increased supply of electrical energy used in the second phase.

25. Process of claim 23 wherein at least a portion of the recovered carbonaceous values is used to produce the electrical energy supplied to the plurality of microwave sources.

26. Process for in situ recovery of extractable carbonaceous values from underground petroleum impregnated porous media, comprising:

subjecting the underground petroleum impregnated porous media in situ to microwave radiation from a microwave distributing source and distributed at least initially at incrementally increasing radiation power and sufficiently for heating the impregnated petroleum content for extracting extractable carbonaceous values therefrom; and recovering the thereby extracted carbonaceous values; and wherein the radiation is distributed initially at incrementally increasing radiation power in a first phase, and thereafter is distributed at substantially constant correspondingly increased power in a second phase.

27. Process for in situ recovery of extractable carbonaceous values from underground petroleum impregnated porous media, comprising:

subjecting the underground petroleum impregnated porous media in situ to microwave radiation from a microwave distributing source and distributed at least initially at incrementally increasing radiation power and sufficiently for heating the impregnated petroleum content for extracting extractable carbonaceous values therefrom; and recovering the thereby extracted carbonaceous values; and wherein the radiation is distributed initially at incrementally increasing radiation power and in intermittent cycles of on and off duration in a first phase, and thereafter is distributed at substantially constant correspondingly increased power continuously in a second phase.

28. Process for in situ recovery of extractable carbonaceous values from underground petroleum impregnated porous media, comprising:

subjecting the underground petroleum impregnated porous media in situ to microwave radiation from a microwave distributing source and distributed at least initially in intermittent cycles of on and off duration and sufficiently for heating the impregnated petroleum content for extracting extractable carbonaceous values therefrom; and recovering the thereby extracted carbonaceous values; wherein the radiation is distributed initially in intermittent interval cycles of on and off duration in a first phase, and thereafter is distributed substantially continuously in a second phase.

29. Process for in situ recovery of extractable carbonaceous values from underground petroleum impregnated porous media, comprising subjecting the underground petroleum impregnated porous media in situ to microwave radiation from a microwave distributing source and distributed at least initially at incrementally increasing radiation power and sufficiently for heating the impregnated petroleum content for extracting extractable carbonaceous values therefrom, and recovering the thereby extracted carbonaceous values; and wherein the radiation is distributed initially in intermittent interval cycles of on and off duration in a first phase, and thereafter is distributed substantially continuously in a second phase

* * * * *

UNITED STATES PATENT AND TRADEMARK OFFICE

CERTIFICATE OF CORRECTION

PATENT NO. : 4,817,711

DATED : April 4, 1989

INVENTOR(S) : Calhoun G. Jeambey

It is certified that error appears in the above-identified patent and that said Letters Patent is hereby corrected as shown below:

Column 4, line 49, change the words "as well as" to --as well and--

Column 9, line 29, change the words "radiation powder" to --radiation power--

Column 11, line 44, change the words "a portionm of the" to --a portion of the--

Column 12, line 22, change the word "Faborably" to --Favorably--

Column 12, line 33, change the words "sensing portionm" to --sensing portion--

Column 13, line 18, change the words "such as array" to --such an array--

Column 13, line 37, change the words "adjusted n" to --adjusted in--

Column 20, line 19, change the words "noncondensible as" to --noncondensible gas--

Column 20, line 56, change the words "via line" to --via feed line--

Column 23, line 63, change "3.14 f" to --3.14ft$^2$--

Column 23, line 64, change "28.29 f" to --28.29ft$^2$--

Column 23, line 65, change "78.57 f" to --78.57ft$^2$--

UNITED STATES PATENT AND TRADEMARK OFFICE

CERTIFICATE OF CORRECTION

PATENT NO. : 4,817,711

DATED : April 4, 1989

INVENTOR(S) : Calhoun G. Jeambey

It is certified that error appears in the above-identified patent and that said Letters Patent is hereby corrected as shown below:

Column 23, line 66, change "176.79 f" to --176.79ft$^2$--

Column 23, line 67, change "289.65 f" to --289.65ft$^2$--

Column 23, line 68, change "491.07 f" to --491.07ft$^2$--

Column 23, line 69, change "707.14 f" to --707.14ft$^2$--

Column 24, line 5, change "1,195.07 f" to --1,195.07ft$^2$--

Column 24, line 6, change "4,538.29 f" to --4,538.29ft$^2$--

Column 24, line 24, change the words "from he borehole" to --from the borehole"

Column 24, line 51, change "4,538,29 ft$^2$" to --4,538.29 ft$^2$--

Column 27, line 56, change the words "and 2 cm" to --and 1 cm--

Column 30, line 64, change the words "uniform absorption" to --uniform material seemingly capable of showing a frequency peak on absorption,--

Column 31, line 33, change the words "through te" to --through the--

Column 31, line 43, change the words "carbon monozide" to --carbon monoxide--

Column 38, line 14, change the words "sectional are of" to --sectional area of--

UNITED STATES PATENT AND TRADEMARK OFFICE

CERTIFICATE OF CORRECTION

PATENT NO. : 4,817,711

DATED : April 4, 1989

INVENTOR(S) : Calhoun G. Jeambey

It is certified that error appears in the above-identified patent and that said Letters Patent is hereby corrected as shown below:

Column 39, line 19, change "44.7" to --14.7--

Column 40, line 34, change the words "two fol" to --two fold--

Column 41, line 57, change the words "Sine organic" to --Since organic--

Column 43, line 10, change the words "including nay" to --including any--

Column 46, line 34, change the words "open face" to --open end face--

Column 49, line 49, change the words "need only by" to --need only be--

Column 50, line 60, change the words "entirety o" to --entirety of--

Column 52, line 1, change the words "surface saeling" to --surface sealing--

Column 57, line 18, change the words "3 to 5 seconds" to --3 to 6 seconds--

Column 59, line 15, change the words "high generation" to --higher generation--

Column 59, line 15, change the words "including not" to --including not only--

UNITED STATES PATENT AND TRADEMARK OFFICE

CERTIFICATE OF CORRECTION

PATENT NO. : 4,817,711

DATED : April 4, 1989

INVENTOR(S) : Calhoun G. Jeambey

It is certified that error appears in the above-identified patent and that said Letters Patent is hereby corrected as shown below:

Column 59, line 47, change the words "undertaken by containing" to --undertaken by continuing--

Column 60, line 17, change the words "heating temperature and in turn" to --heating temperature and for gasifying substantially the volatilizable petroleum constituents present which gasify at such heating temperature and in turn--

Column 63, line 17, change the words "about 425°-400°C to --about 425-500°C--

Signed and Sealed this

Tenth Day of July, 1990

*Attest:*

HARRY F. MANBECK, JR.

*Attesting Officer*

*Commissioner of Patents and Trademarks*